US010309683B2

(12) United States Patent
Choi et al.

(10) Patent No.: US 10,309,683 B2
(45) Date of Patent: Jun. 4, 2019

(54) INDOOR UNIT OF AIR CONDITIONER

(71) Applicant: LG ELECTRONICS INC., Seoul (KR)

(72) Inventors: Byeonggeol Choi, Seoul (KR); Youngjoong Kim, Seoul (KR); Joseph Park, Seoul (KR); Jongwook Park, Seoul (KR); Jungjig Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 143 days.

(21) Appl. No.: 15/233,555

(22) Filed: Aug. 10, 2016

(65) Prior Publication Data

US 2017/0045259 A1 Feb. 16, 2017

(30) Foreign Application Priority Data

Aug. 11, 2015 (KR) ..... 10-2015-0113499
Aug. 11, 2015 (KR) ..... 10-2015-0113503
Aug. 11, 2015 (KR) ..... 10-2015-0113507

(51) Int. Cl.
*F25D 21/14* (2006.01)
*F24F 13/08* (2006.01)
(Continued)

(52) U.S. Cl.
CPC ..... *F24F 13/084* (2013.01); *F24F 1/0014* (2013.01); *F24F 1/0022* (2013.01);
(Continued)

(58) Field of Classification Search
CPC ..... F24F 13/084; F24F 13/06; F24F 13/1426; F24F 13/20; F24F 13/222; F24F 13/32;
(Continued)

(56) References Cited

U.S. PATENT DOCUMENTS

2009/0025414 A1* 1/2009 Koga ..... F24F 1/0007 62/263
2015/0129179 A1* 5/2015 Moon ..... F25D 17/06 165/121

FOREIGN PATENT DOCUMENTS

CN 1553090 A 12/2004
CN 101078553 A 11/2007
(Continued)

OTHER PUBLICATIONS

Machine Translation JP2004101056.*
Office Action of Chinese Patent Office in Appl'n No. 201610608178.3, dated Sep. 30, 2018.

*Primary Examiner* — Joseph F Trpisovsky
(74) *Attorney, Agent, or Firm* — Dentons US LLP

(57) ABSTRACT

An inside unit of an air conditioner that includes a cabinet that accommodates a fan and a heat exchanger, a front panel mounted on an open surface of the cabinet and forming an inlet port through which inside air is suctioned into a depressed inside area and a panel outlet port through which heat-exchanged air is discharged, a vane provided on the panel outlet port and controlling opening degree of the panel outlet port by the rotation, an air guide that extends along an outside end of the panel outlet port and is formed of a heat insulating material, a slide preventing protrusion that protrudes from the front panel in which the air guide is mounted, and a protrusion accommodating groove depressed in the bottom surface of the air guide corresponding to the slide preventing protrusion and the slide preventing protrusion is received in the protrusion accommodating groove.

19 Claims, 21 Drawing Sheets

(51) Int. Cl.

| | |
|---|---|
| ***F24F 13/14*** | (2006.01) |
| ***F24F 13/22*** | (2006.01) |
| ***F24F 1/0014*** | (2019.01) |
| ***F24F 13/06*** | (2006.01) |
| ***F24F 1/0022*** | (2019.01) |
| ***F24F 1/0059*** | (2019.01) |
| ***F24F 13/20*** | (2006.01) |
| ***F24F 13/32*** | (2006.01) |
| ***F24F 11/89*** | (2018.01) |
| *F24F 13/24* | (2006.01) |
| *F24F 1/00* | (2019.01) |

(52) U.S. Cl.
CPC ..... *F24F 1/0059* (2013.01); *F24F 11/89* (2018.01); *F24F 13/06* (2013.01); *F24F 13/1426* (2013.01); *F24F 13/20* (2013.01); *F24F 13/222* (2013.01); *F24F 13/32* (2013.01); *F24F 13/24* (2013.01); *F24F 2001/0037* (2013.01); *F24F 2013/0616* (2013.01); *F24F 2013/1433* (2013.01); *F24F 2013/207* (2013.01)

(58) Field of Classification Search
CPC ..... F24F 13/24; F24F 11/89; F24F 1/0014; F24F 1/0022; F24F 1/0059; F24F 2001/0037; F24F 2013/0616; F24F 2013/1433; F24F 2013/207
USPC ..... 62/291
See application file for complete search history.

(56) References Cited

FOREIGN PATENT DOCUMENTS

| | | | |
|---|---|---|---|
| CN | 101387425 | A | 3/2009 |
| EP | 2 017 544 | A1 | 1/2009 |
| EP | 2 023 049 | A2 | 2/2009 |
| EP | 2 824 401 | A1 | 1/2015 |
| JP | 2004-101056 | A | 4/2004 |
| JP | 2010-38490 | A | 2/2010 |
| KR | 10-2003-0042713 | A | 6/2003 |
| KR | 10-2015-0041340 | A | 4/2015 |

* cited by examiner

INDOOR UNIT OF AIR CONDITIONER

CROSS-REFERENCE TO RELATED APPLICATIONS

The application claims priority under 35 U.S.C. § 119 and 35 U.S.C. § 365 to Korean Patent Application Nos.: 10-2015-0113503 (filed Aug. 11, 2015), 10-2015-0113499 (filed Aug. 11, 2015), and 10-2015-0113507 (filed Aug. 11, 2015), whose entire disclosures are hereby incorporated by reference.

BACKGROUND

1. Field

An inside unit of an air conditioner is disclosed herein.

2. Background

Generally, an air conditioner is a cooling and heating system which heats and cools a room by repeatedly suctioning inside air, exchanging heat with a low temperature or high temperature refrigerant, and then discharging the heat-exchanged air into the room. The air conditioner is an apparatus which forms a series of cycles and includes a compressor, a condenser, an expansion valve and an evaporator.

In particular, the air conditioner is divided into an outside unit (which may be referred to as an "outside side," "heat radiating side," or "outside unit") which is installed at an outside, and an inside unit (which may be referred to as an "inside side," "heat absorbing side," or "inside unit") which is mainly installed at an inside of a dwelling or building. The condenser (an outside heat exchanger) and the compressor are installed at the outside unit, and the evaporator (an inside heat exchanger) is installed at the inside unit.

The air conditioner may be classified into a separate type air conditioner in which the outside unit and the inside unit are separately installed, and an integral type air conditioner in which the outside unit and the inside unit are integrally installed. The separate type air conditioner is generally preferred in consideration of an installation space, a noise, or the like.

In a multi-type air conditioner among the separate type air conditioners, a plurality of inside units are generally connected to a single outside unit, and the inside units are installed in rooms to be air-conditioned, respectively, and thus an effect as if several air conditioners are installed may be obtained. One example of an inside unit of a multi-type air conditioner is an inside unit of a cassette type air conditioner, which is installed at a ceiling of an inside space and heats and cools the inside space.

Korean Patent Publication No. 10-2009-0006305, which is incorporated herein by reference, discloses an inside unit of a cassette type air conditioner installed in the ceiling. In order to fix the inside unit on the wall surface of the ceiling, it has a structure in which an installation means constituted with an anchor bolt and a bolt socket is mounted on an outside of a cabinet. In order to install, because a lower panel is mounted after the cabinet is mounted, the workability is degraded. In order to balance after installation or adjust other installation, the lower panel should be removed and then mounted again, etc., which significantly affects workability.

Korean Patent Publication No. 10-2008-0052927, which is incorporated herein by reference, discloses an inside unit of an air conditioner which forms an access hole on the four corners of a front surface panel, and which may control an installation state of the inside unit through accessing to an installation bracket through opening of the access hole. However, according to such a structure, for operating the installation means mounted on the installation bracket, because all four access hole covers should be opened or closed, there is a problem that the workability is poor. Because the four openable access holes are installed and an access hole cover should be mounted in a rotatable structure, there is a problem that not only the assembly work is increased, but also the productivity is decreased.

Korean Patent Publication No. 10-2009-0074374, which is incorporated herein by reference, discloses an inside unit of a cassette type air conditioner installed on the ceiling. The apparatus includes a fan, a heat exchanger, a fan motor, and a drain pan collecting condensed water of the heat exchanger are provided inside of a cabinet, and a structure in which a front panel shielding an opened surface of the cabinet is exposed to the ceiling surface. Also disclosed is a structure in which air is suctioned through an inlet port formed in the front panel and then discharged to an outlet port. According the inside unit of the air conditioner of such a structure, when the temperature of the discharged air is excessively lower than that of inside air, condensation on a surface of the outlet port may occur by the temperature difference and water generated by the condensation may drop into an inside space.

To prevent such a problem, an additional configuration for insulation or preventing dew condensation on the outlet port side may be added, but there is a problem that such a configuration is dropped or noise and vibration are generated by a continuous air flow.

In addition, an fan, a heat exchanger, a fan motor, and a drain pan collecting the condensed water of the heat exchanger are provided inside of a cabinet installed on the ceiling, and a control box is provided on one side of the drain pan, and a structure in which a front panel shielding a lower surface of the cabinet is exposed to the ceiling surface is disclosed. At the inside unit of the air conditioner of such a structure, for a service operation, such as maintenance or repair of the control box, the opened surface of the cabinet should be exposed by completely separating the front panel. Such configuration is problematic in that it requires that the front panel be separated and re-assembled upon every service operation.

SUMMARY

The present disclosure is directed to providing an inside unit of an air conditioner configured so that all the access holes which are accessible to a mounting bracket installed on a cabinet can be opened when a suction grille is opened, and thus the operation ease of a service may be improved.

According to an aspect of the present disclosure, there is provided an inside unit of an air conditioner, including a cabinet housing a fan and a heat exchanger, a front panel attached at an opening of the cabinet, the front panel forming an inlet port through which inside air is suctioned into a depressed inner side area, and an outlet port through which heat-exchanged air is discharged, a vane provided at the outlet port to control an opening degree of the outlet port, an air guide that extends along an outer side end of the outlet port, a slide preventing protrusion that protrudes from the front panel in which the air guide is mounted, and a protrusion accommodating groove formed at the bottom surface of the air guide to accommodate the slide preventing protrusion.

Also, the inside unit of the air conditioner of the present disclosure may include more than one slide preventing protrusion is formed to protrude along an end of the outlet port.

Also, the inside unit of the air conditioner of the present disclosure may include a guide surface formed in the air guide, the guide surface being curved to guide a flow of the air to the outlet port.

Also, the inside unit of the air conditioner of the present disclosure may include a side wall formed on the front panel for supporting a surface of the air guide, and a coupling groove formed on the side wall in which a coupling protrusion protruding from the air guide is inserted.

Also, the inside unit of the air conditioner of the present disclosure includes a mounting bracket provided at an outer side surface of the cabinet, an installation device coupled to the mounting bracket, a grille accommodating portion forming a panel opening formed to be depressed in the front panel, and through which the inside air is suctioned into the depressed inner side area, a suction grille to open and close the grille accommodating portion, the suction grille forming the inlet port, and an access hole that is opened at the grille accommodating portion so that the mounting bracket is exposed.

Also, the inside unit of the air conditioner of the present disclosure includes a drain pan assembly provided at an inner side of the cabinet, the drain pan assembly forming an air flow passage and collecting condensed water generated at the heat exchanger, a panel opening provided at a center of the front panel, a suction grille configured to open and close the panel opening and forming the inlet port, and a control box provided at the inner side of the cabinet and exposed to the panel opening.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION

Hereinafter, exemplary embodiments of the present disclosure will be described in detail with reference to the accompanying drawings. It is understood that the description herein is not intended to limit the claims to the specific embodiments described. On the contrary, it is intended to cover alternatives, modifications, and equivalents as may be included within the spirit and scope of the present disclosure.

Figure 1:
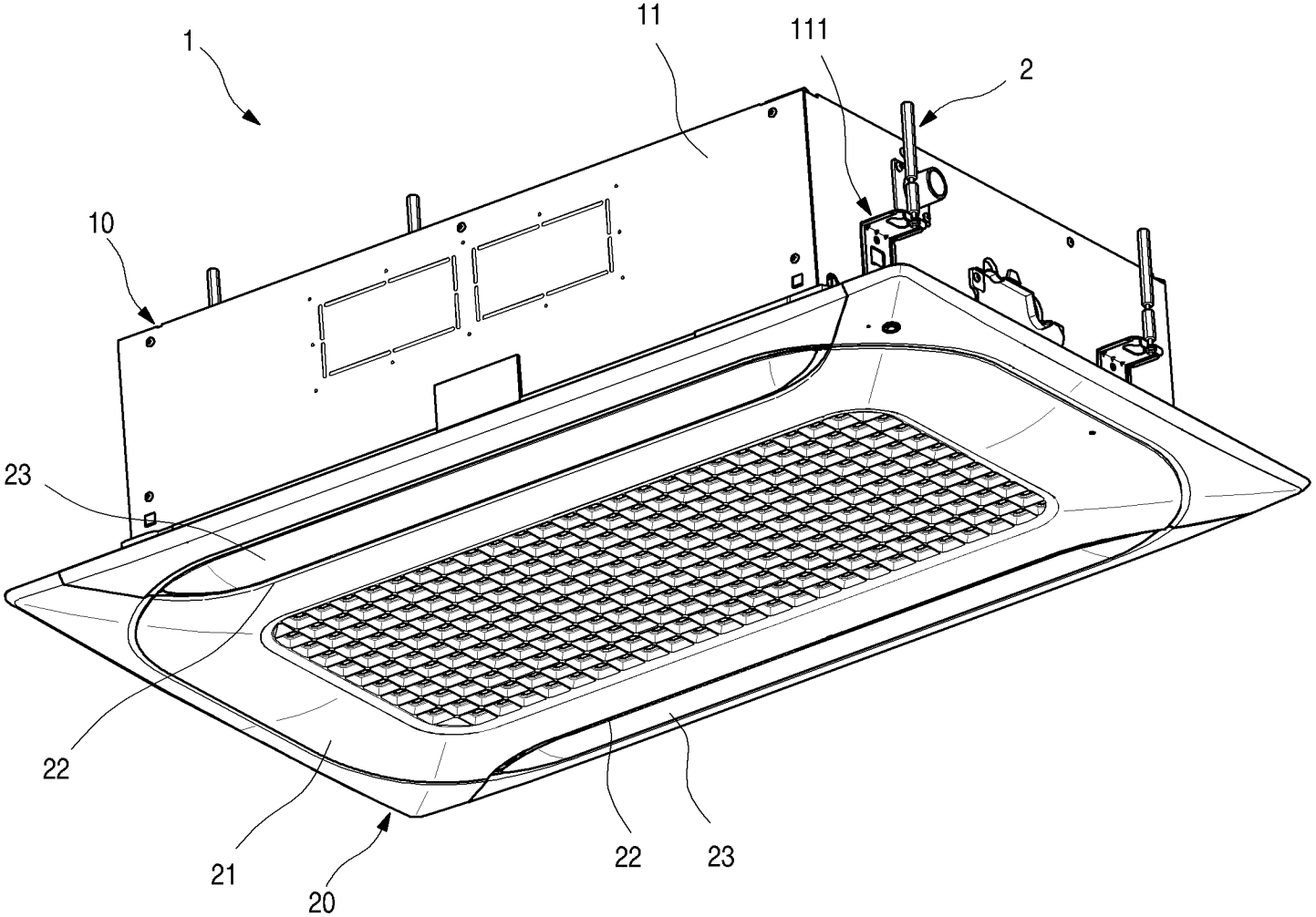
FIG. 1 is a perspective view of an inside unit of an air conditioner according to an embodiment of the present disclosure.
Figure 2:
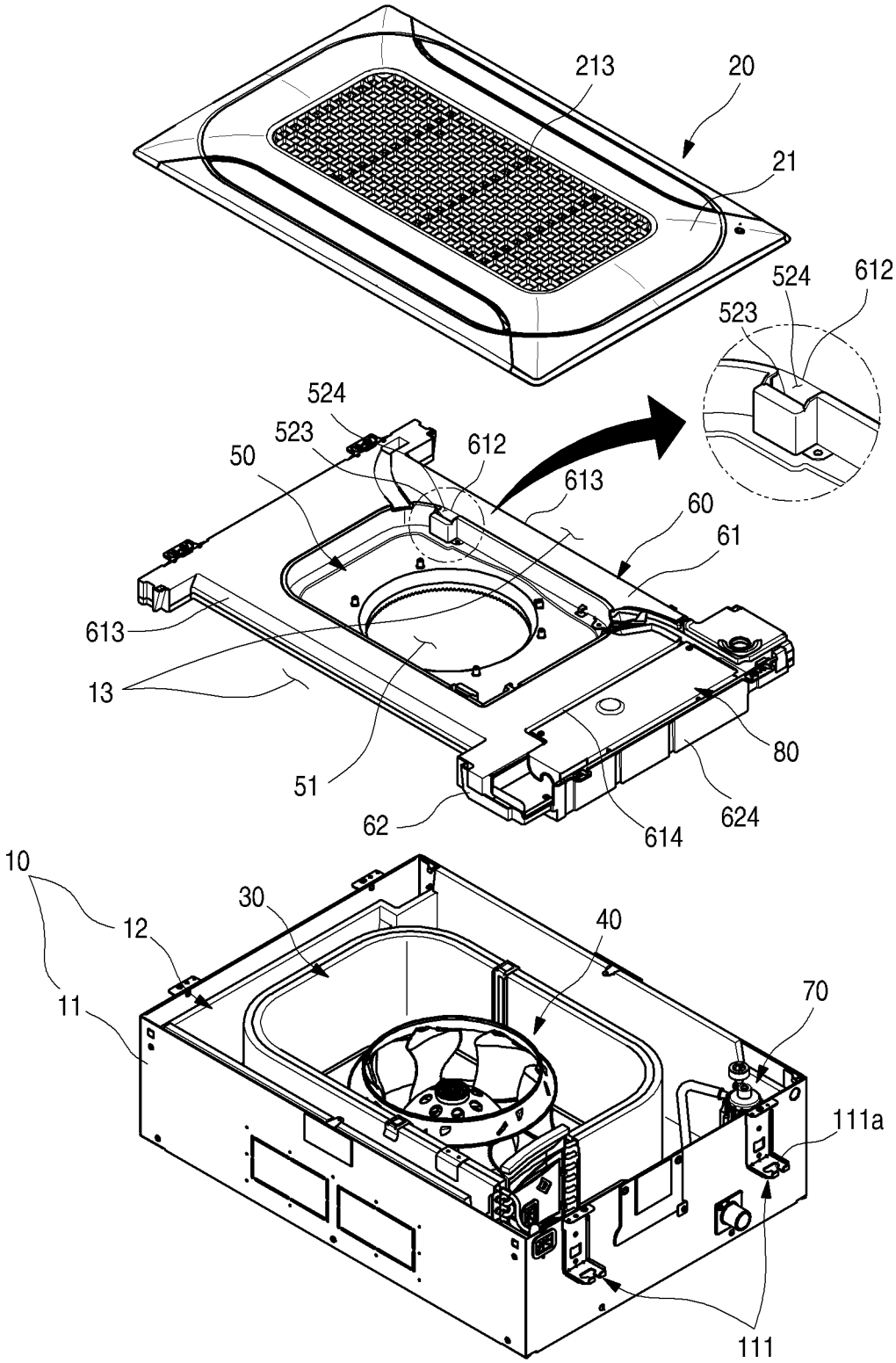
FIG. 2 is a exploded perspective view of the inside unit.

FIG. 1 is a perspective view of an inside unit of an air conditioner according to an embodiment of the present disclosure. FIG. 2 is an exploded perspective view of the inside unit.

As shown, an inside unit 1 (hereinafter referred to as "inside unit") may be configured with a cabinet 10 generally inserted into or attached to a ceiling of the inside surface, a front panel 20 provided at the lower end of the cabinet 10 and forming the external appearance of the bottom surface, and a suction grille 21. The front panel 20 may be exposed to the lower side of the ceiling when the inside unit 1 is installed.

A heat exchanger 30 exchanging heat with the suctioned air, a fan 40 for suctioning and discharging the inside air, an orifice member 50 guiding the air suctioned toward a fan 40, a drain pan assembly 60 collecting condensed water generated in the heat exchanger 30, and a drain pump 70 for discharging the collected condensed water to the outside may be provided at the inside of the cabinet 10.

As shown, the front panel 20 may be mounted or attached at the lower end of the cabinet 10. The front panel 20 may be formed in a substantially rectangular shape when viewed from below. The front panel 20 may protrude further outside than the lower end of the cabinet 10, and it may be configured so that a periphery of the front panel 20 is coupled with the lower surface of the ceiling.

A panel outlet port 22, which is an exit port for the air discharged through the cabinet 10, may be formed in the front panel 20. The panel outlet port 22 may be formed at a position in which both sides of the front panel 20 are facing each other, and it may be formed at a position corresponding to the outer end of the cabinet 10. The panel outlet port 22 may be formed longer along a lengthwise direction of the front panel 20. Further, the panel outlet port 22 may be configured to be opened and closed by a vane 23 mounted at the front panel 20.

The suction grille 21 may be mounted or attached at the central portion of the front panel 20. The suction grille 21 may form a lower surface exterior portion of the inside unit 1. The suction grille 21 may be located between the pair of the panel outlet ports 22. The suction grille 21 may be formed in a plate which may shield the opening of a center of the front panel 20.

The suction grille 21 forms a passage of an air inserted into the inside of the inside unit 1. That is, at least a portion of the suction grille 21 is formed in a grille or grid-like configuration, and a plurality of inlet pots 213 may be formed so that the inflow of inside air is performed efficiently.

The cabinet 10 may be configured with an out plate 11 forming an exterior and an inner case 12 provided at the inner side of the out plate 11.

The out plate 11 may be configured to form an appearance of the cabinet 10 through which the lower surface is opened by a steel material of plate. The out plate 11 may be formed through the configurations forming each surface are combined each other. Alternatively, the out plate 11 may be formed to be bent so as to have at least one surface.

Each two of mounting brackets 111 may be provided at both side surfaces of the out plate 11. When the inside unit 1 is installed at an inside space, an installation device 2 may be attached to the mounting bracket 111, and then the inside unit 1 may be installed in the inside space by the installation device 2.

The installation device 2 may be fixed to a ceiling surface, and extended in a vertical direction. The device 2 may be configured with an anchor bolt passing through a mounting hole 111*a* of the mounting bracket 111, and an anchor socket fastened to the anchor bolt passing through the mounting bracket 111. Therefore, the installation device 2 may be mounted to be fixed respectively to the four mounting brackets 111 provided on the out plate 11, and it may fix the inside unit 1. It is understood that the installation device 2 is not limited to the foregoing configuration.

An installation position of the mounting bracket 111 may be located at the right and left sides from both sides surfaces, and it may be located at a vertically upward side of an access hole 25 of the front panel 20, as described below. Therefore, access to the mounting bracket 111 is possible through the access hole 25, and an operation such as mounting or changing installation position or horizontal operation of the inside unit 1 will be possible through the operation of the installation device 2.

The inner case 12 may be formed at the inner side surface of the out plate 11. The inner case 12 may be formed of an insulating material such as EPS (expended polystyrene) so as to insulate the interior of the cabinet 10 and prevent or reduce vibration noise. The inner case 12 may be in close proximity with the out plate 11 and form the shape of the interior of the cabinet 10. Alternatively, the inner case 12 may be formed so that a surface which is in close proximity with the front panel 20 is completely opened.

The fan 40 may be provided at the inner side space of the inner case 12, and the heat exchanger 30 may be disposed at the periphery of the fan 40. The heat exchanger 30 may be disposed along the inner side surface of the inner case 12. The heat exchanger 30 may be formed so as to be spaced apart from the wall surface and fan 40 of the inner case 12.

Therefore, an air suctioned in the axial direction of the fan 40 may be discharged while rotating in the circumferential direction of the fan 40, and it may exchange heat with a refrigerant while passing through the heat exchanger 30.

A drain pan assembly 60 may be mounted or attached at an opened surface of the cabinet 10. The drain pan assembly 60 may shield the opened surface of the cabinet 10. The drain pan assembly 60 may have a structure seated on an upper end of the inner case 12.

By the mounting of the drain pan assembly 60, an outlet port 13 through which air communicated and heat-exchanged with the panel outlet port 22 is discharged may be defined at both sides of the cabinet 10. And an inlet port opened so that air passing through the suction grille 21 and suctioned is directed toward the fan 40 side is formed at a center of the drain pan assembly 60.

The drain pan assembly 60 may be configured with a body 61, a pan plate 62 forming a surface facing an inner side of the inner case 12, and the orifice member 50 mounted in a center of the body 61.

The body 61 may be formed of the same material as that of the inner case 12, and it may insulate the interior of the cabinet 10. The body 61 may form the overall shape of the drain pan assembly 60.

The orifice member 50 may be mounted at the center of the body 61, and a panel inserting portion 612 may be formed to be depressed at one side in which the body 61 and the orifice member 50 are contacted. The panel inserting portion 612 may be formed at a position corresponding to a panel fixing portion 523 formed on the orifice member 50 when the orifice member 50 is mounted, and it forms a space at which a panel coupling portion 202 of the front panel 20 may be inserted.

The orifice member 50 may be mounted to the opened center of the body 61. The orifice member 50 may comprise a plastic material that is formed by injection molding. An orifice hole 51 may be formed at a center of the orifice member 50, and the suctioned air may be directed toward the fan 40 through the orifice hole 51.

An edge having a predetermined height is formed on the periphery of the bottom surface of the orifice member 50, and on the edge of the orifice member 50, the panel fixing portion 523 may be formed at a position corresponding to the panel inserting portion 612.

The panel inserting portion 612 and the panel fixing portion 512 form a coupling portion inserting port 524 by the orifice member 50 being mounted on the body 61. The panel coupling portion 202 may be inserted through the coupling portion inserting port 524 to be hung with the panel fixing portion 523. Therefore, the front panel 20 may have a structure that is fixed with one side of the drain pan assembly 60.

A recessed portion 613 recessed at the inner side is formed at both sides surfaces of the body 61. The recessed portion 613 may form the outlet port 13 when the drain pan assembly 60 is mounted. A box accommodating portion 614 providing a space in which a control box 80 may be disposed may be formed at the other side surface of the body 61.

The pan plate 62 may be provided at a lower portion of the body 61. The pan plate 62 may accommodate the lower portion of the body 61, and form an entire lower surface of the drain pan assembly 60. The pan plate 62 may be formed of a plastic material which is different from that of the body 61, and form an outer appearance of the lower surface of the drain pan assembly 60.

The pan plate 62 may have a structure through which the body 61 is press-fitted or bonded to the pan plate 62 and coupled to each other after injection molding of the plastic material. In addition, the pan plate 62 may be formed to be insert-injected when the body 61 is molded. Alternatively, the pan plate 62 and the body 61 may be integrally formed of a same material.

A space in which the condensed water is collected may be formed on the pan plate 62, and an inlet side of the drain pump 70 is located in the pan plate 62 and may be configured to suction and discharge the collected condensed water. A heat exchanger accommodating portion in which an end portion of the heat exchanger 30 is received may be formed to be depressed at the pan plate 62.

A control box seating portion 624 that is disposed on the box accommodating portion 614 side when coupled with the body 61, so that the control box 80 may be seated in the control box seating portion 624, may be formed at one side of the pan plate 62. Although the control box 80 is provided on the control box seating portion 624, it may be exposed to a panel opening 24 of the front panel 20 when the suction grille 21 is opened.

Figure 3:
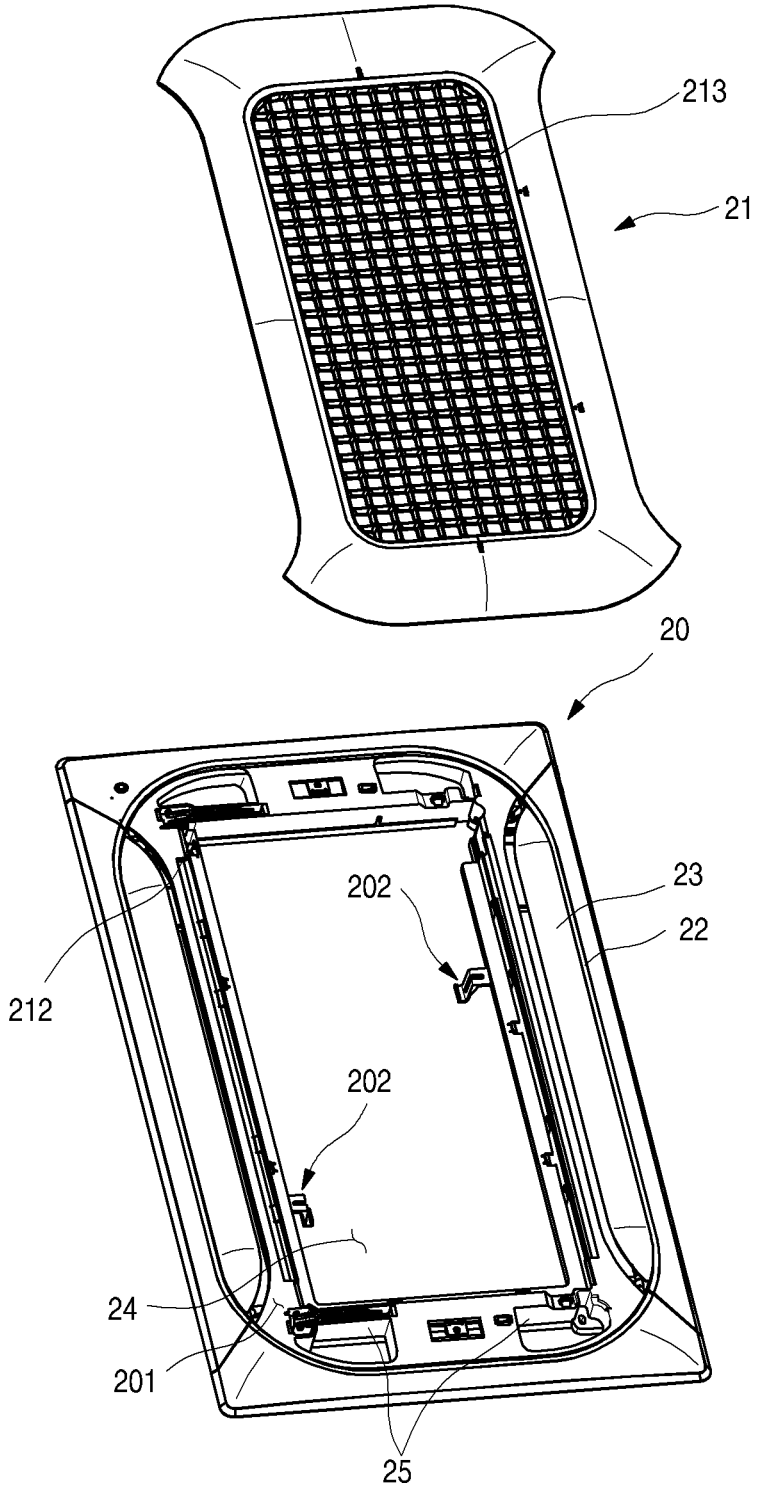
FIG. 3 is a exploded perspective view illustrating a combined structure of a suction grille and a front panel according to an embodiment of the present disclosure.
Figure 4:
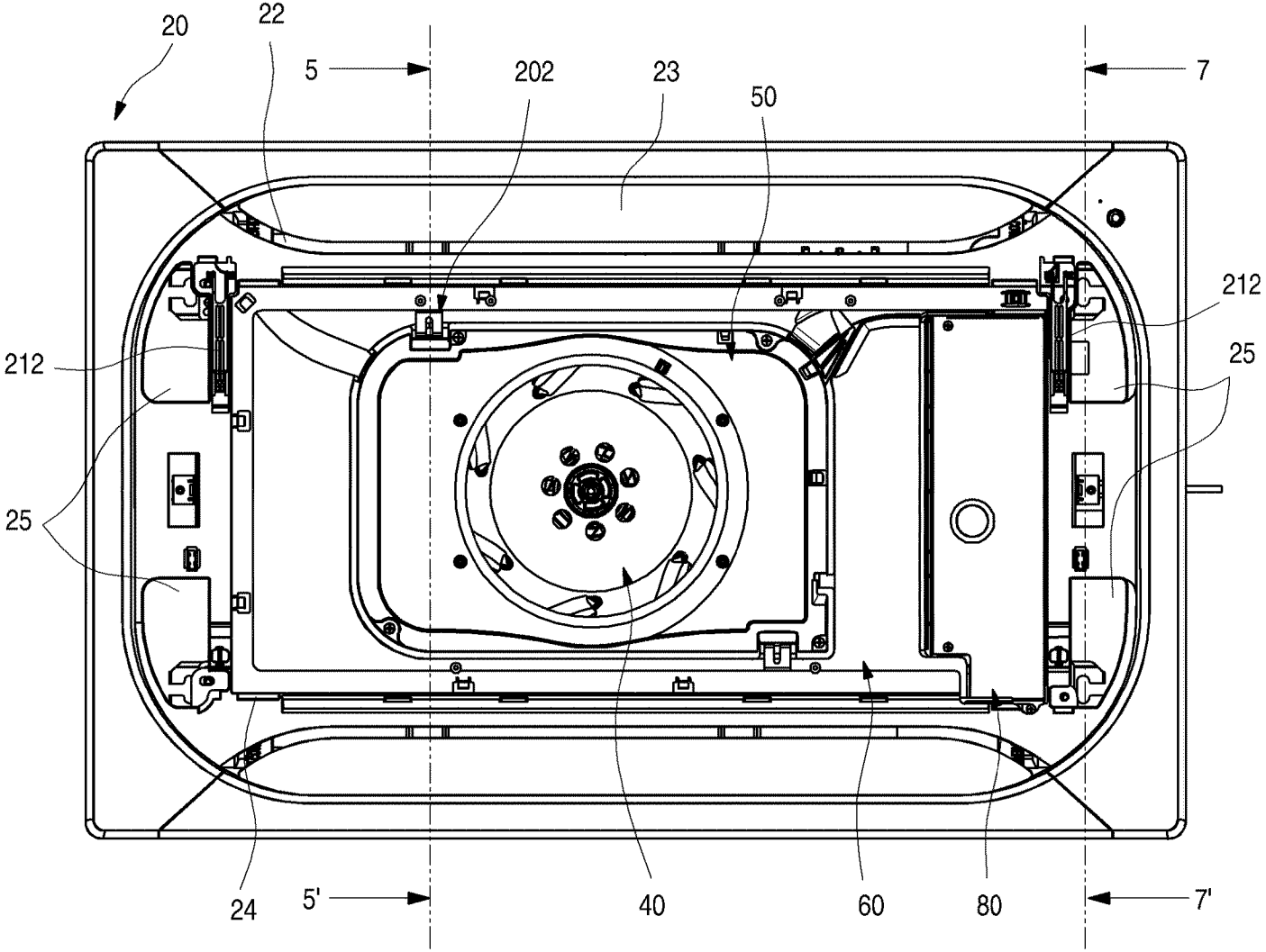
FIG. 4 is a sectional view of the opened suction grill.
Figure 5:
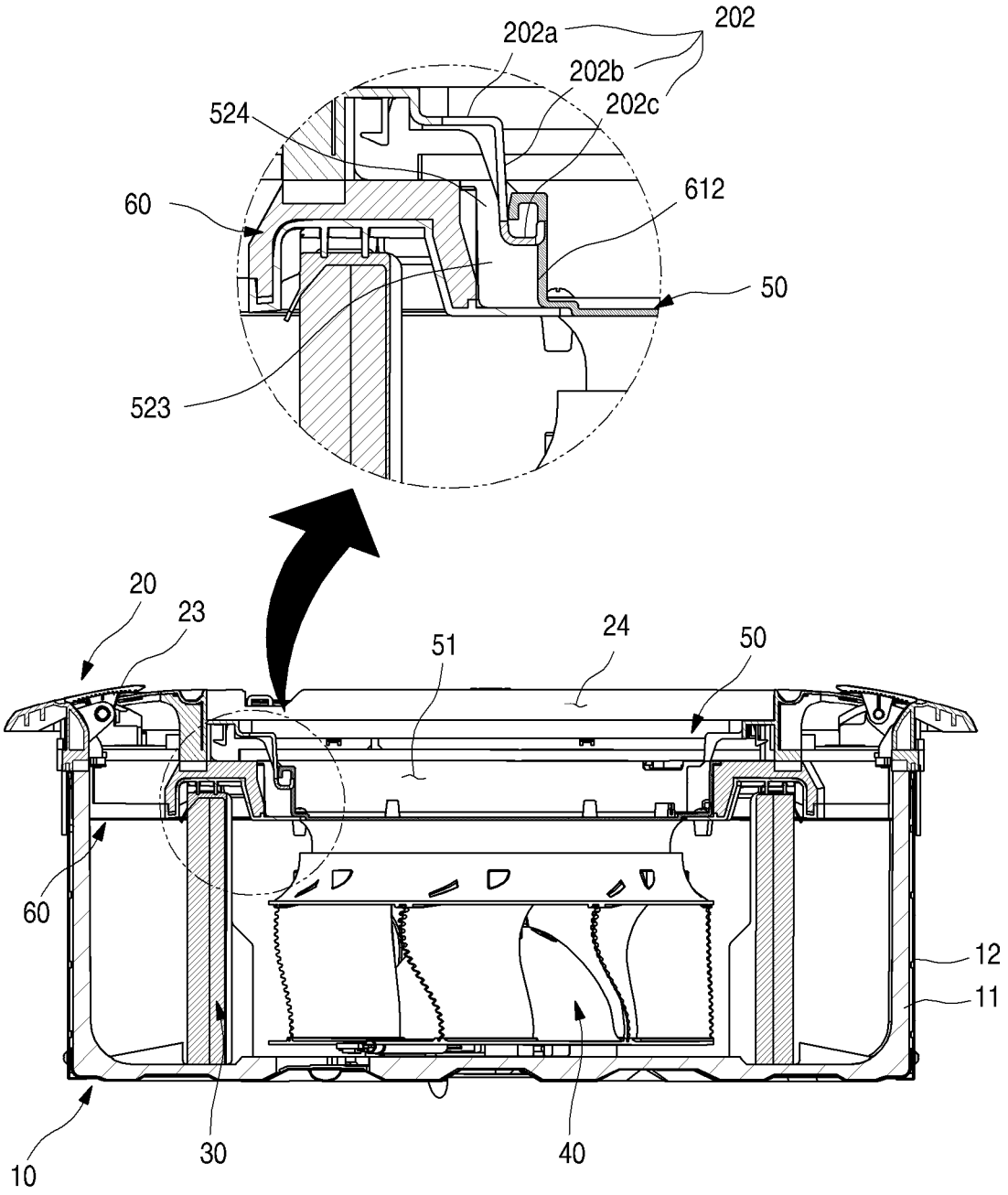
FIG. 5 is a 5-5' cross-sectional view of the FIG. 4.
Figure 6:
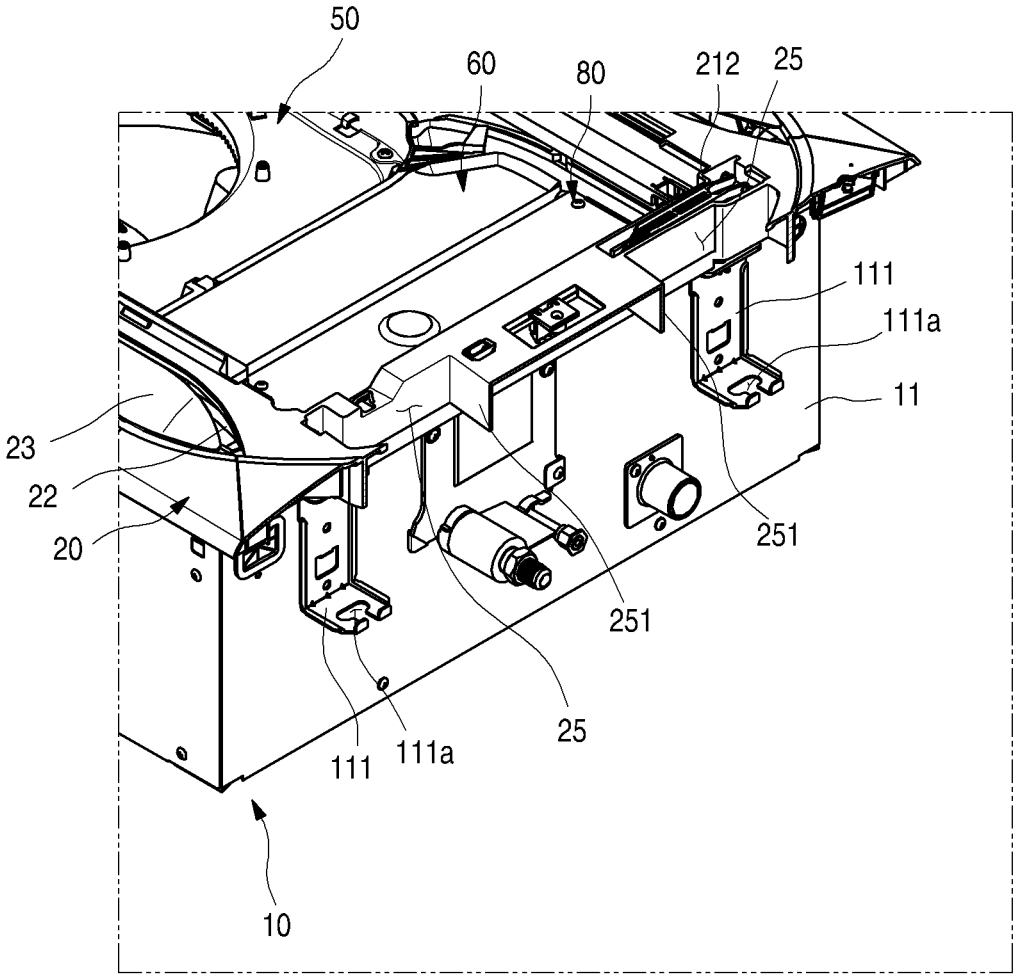
FIG. 6 is a partial cutout perspective view of the front panel.

FIG. 3 is a exploded perspective view illustrating a combined structure of a suction grille and a front panel according to an embodiment of the present disclosure. FIG. 4 is a sectional view of the opened suction grille. FIG. 5 is a 5-5' cross-sectional view of the FIG. 4. FIG. 6 is a partial cutout perspective view of the front panel.

As shown in FIGS. 3-6, the front panel 20 may be formed having a rectangular shape that is larger than the size of the cabinet 10.

A grille accommodating portion 201 depressed along the shape of the front panel 20 has generally rounded corners. The panel opening 24 may have a rectangular shape and be formed at an inner side center of the grille accommodating portion 201.

The panel opening 24 may be configured to correspond to the size of the opened top surface of the cabinet 10, and it may be configured so that the internal structure of the cabinet 10 is exposed. A coupling member, such as a screw, may be fastened to the periphery of the panel opening 24, so that the cabinet 10 and the front panel 20 are firmly coupled to each other.

The panel coupling portion 202 may be formed at both sides of a side surface of the panel opening 24. The panel coupling portion 202 is provided for fixing the front panel 20 to the cabinet 10, more specifically, to the drain pan assembly 60. The panel coupling portion 202 may be configured to be inserted into the coupling portion inserting port 524 formed in the drain pan assembly 60.

The panel coupling portion 202 and the coupling portion inserting port 524 may provide a provisional fixing structure, so that the front panel 20 may maintain a temporary fixed state without falling down when the front panel 20 is mounted and disassembled.

The panel coupling portion 202 may be configured with a horizontal portion 202*a* that extends from an inside surface of the panel opening 24 to inside of the panel opening 24, a vertical portion 202*b* extended downward from an end of the horizontal portion 202*a*, and a hanging portion 202*c* protruding from an end of the vertical portion 202*b* to a side thereof.

As shown in FIG. 5, the panel coupling portion 202 is inserted in an inner side of the coupling portion inserting port 524 while the front panel 20 is coupled. The vertical portion 202*b* is inserted into the inner side of the coupling portion inserting port 524, and the hanging portion 202*c* may be bonded or attached to the panel fixing portion 523. In such configuration, the panel coupling portion 202 may maintain a fixed state in the drain pan assembly 60.

The panel coupling portion 202 may be formed at the inside surface of the panel opening 24 facing each other, and disposed to cross each other and it may be formed so that the front panel 20 and the drain pan assembly 60 have a generally stable coupling structure.

The panel outlet port 22 may be formed at the grille accommodating portion 201 on the front panel 20. The panel outlet port 22 may be located between the panel opening 24 and an outside end of the grille accommodating portion 201. The panel outlet port 22 may extend along a length direction of the front panel 20.

The panel outlet port 22 may extend along the outside end of the depressed grille accommodating portion 201. Both ends of the panel outlet port 22 may have a rounded shape along the rounded edge of the grille accommodating portion 201. A vane 23 for opening and closing the panel outlet port 22 may be provided on the panel outlet port 22. The vane 23 may guide the discharge direction of heat-exchanged air discharged from the panel outlet port 22.

An access hole 25 may be formed at both sides of the other grille accommodating portion 201 intersected with the panel outlet port 22. The access hole 25 may be opened between the panel opening 24 and the outside end of the grille accommodating portion 201. Two access holes 25 may be formed on each of both sides.

The access hole 25 may be formed to penetrate the front panel 20, and communicate with the outside area of the cabinet 10. In detail, the access hole 25 may be formed at a vertical lower portion of the mounting bracket 111 so that a user can manipulate the installation device 2. Therefore, the mounting bracket 111 may be exposed through the access hole 25.

At least a portion of the access hole 25 may be formed along the outside end of the grille accommodating portion 201, and a pair of access holes 25 which are formed on the same side surface may be spaced apart from each other. An edge portion 251 extended toward the mounting bracket 111 side may be formed at the perimeter of the access hole 25. The edge portion 251 prevents an unnecessary portion from being exposed toward the access hole 25 side.

A hinge device 212 connected with the suction grille 21 is provided in the grille accommodating portion 201. The hinge device 212 is configured to rotate so that the suction grille 21 opens and closes the panel opening 24 and the access hole 25 simultaneously. Both side ends of the hinge device 212 may be rotatably connected to the front panel 20 and the suction grille 21, and one pair of hinge devices 212 may be located in one direction of the suction grille 21.

A restriction device 211 for maintaining a state in which the suction grille 21 is mounted to be fixed to the front panel 20 may be provided at the other side of the suction grille 21. The restriction device 211 may be partially exposed to the outside of the suction grille 21, and the suction grille 21 may be selectively released from the front panel 20 by the user's operation and may be rotatably configured.

The suction grille 21 may be formed to shield the panel opening 24 opened at the center of the front panel 20. The suction grille 21 may be located at the inner side of the grille accommodating portion 201 of the front panel 20, and it may be formed along an inner side end of the panel outlet port 22 and the outer side end of the grille accommodating portion 201. In other words, the ends of both sides of the suction grille 21 may be formed to correspond to the inner side end shape of the panel outlet port 22, and the ends of the other both sides of the suction grille 21 may be formed along the depressed line of the grille accommodating portion 201.

Therefore, the suction grille 21, when closed, may cover the grille accommodating portion 201 including the panel opening 24 and the access hole 25, and may form an inner side end line of the panel outlet port 22. In addition, it is spaced apart a predetermined distance from a depressed line of the grille accommodating portion 201 so that a line of the grille accommodating portion 201 may be viewed in a closed-loop shape through the exterior.

Figure 7:
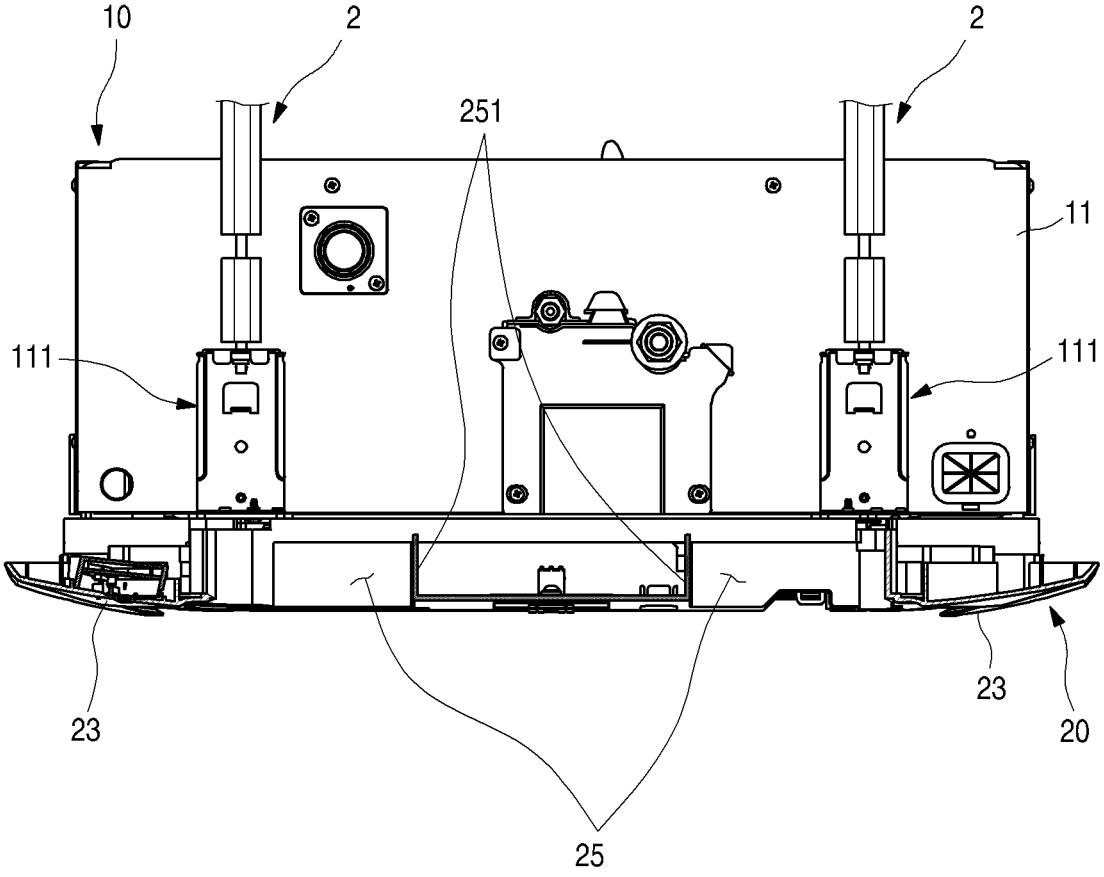
FIG. 7 is a 7-7' cross-sectional view of the FIG. 4.
Figure 8:
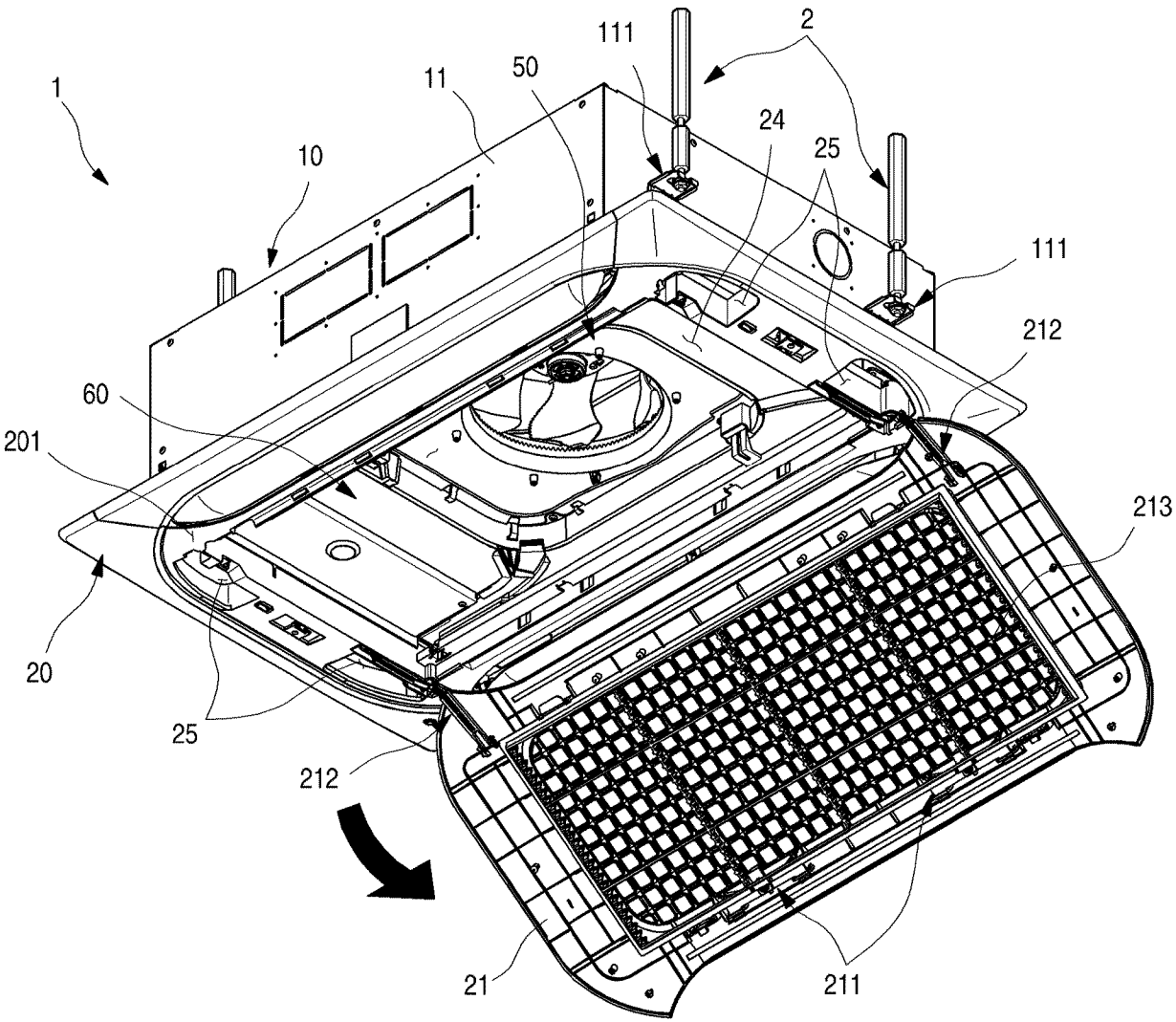
FIG. 8 is a perspective view of the opened suction grill.

Hereinafter, a process for adjusting an installation state of the inside unit 1 according to an embodiment of the present disclosure having the above-described structure will be described with reference to FIGS. 7 and 8. FIG. 7 is a 7-7' cross-sectional view of the FIG. 4. FIG. 8 is a perspective view of the opened suction grille.

When a service, such as an inspection or replacement of a PCB 83 is required while the inside unit 1 is mounted or attached to the ceiling, first the suction grille 21 is opened, as shown in FIG. 8. The suction grille 21 and the front panel 20 may be released by manipulating the restriction device 211. An opposite side of the restriction device 211 is connected to the hinge device 212 and may be rotated by the hinge device 212 while being connected with the front panel 20.

By such an operation, the grille accommodating portion 201 of the front panel 20 may be completely opened. Therefore, the opened surface of the cabinet 10 may be completely exposed through the panel opening 24. Additionally, all of the four access holes 25 provided at both sides of the grille accommodating portion 201 may be completely opened.

The mounting bracket 111 and the installation device 2 attached with the mounting bracket 111 may be exposed through the access hole 25. Therefore, the operator may control the coupling of the mounting bracket 111 and the installation device 2 by putting his or her hand into the access hole 25. By controlling the coupling of each mounting bracket 111 and the installation device 2 through the four access holes 25, the mounting state of the entire inside unit 1 may be adjusted. After controlling the mounting state of the inside unit 1, the suction grille 21 may be rotated to simultaneously cover the panel opening 24 and the access hole 25 and be fixed at the front panel 20 by the restriction device 211.

Figure 9:
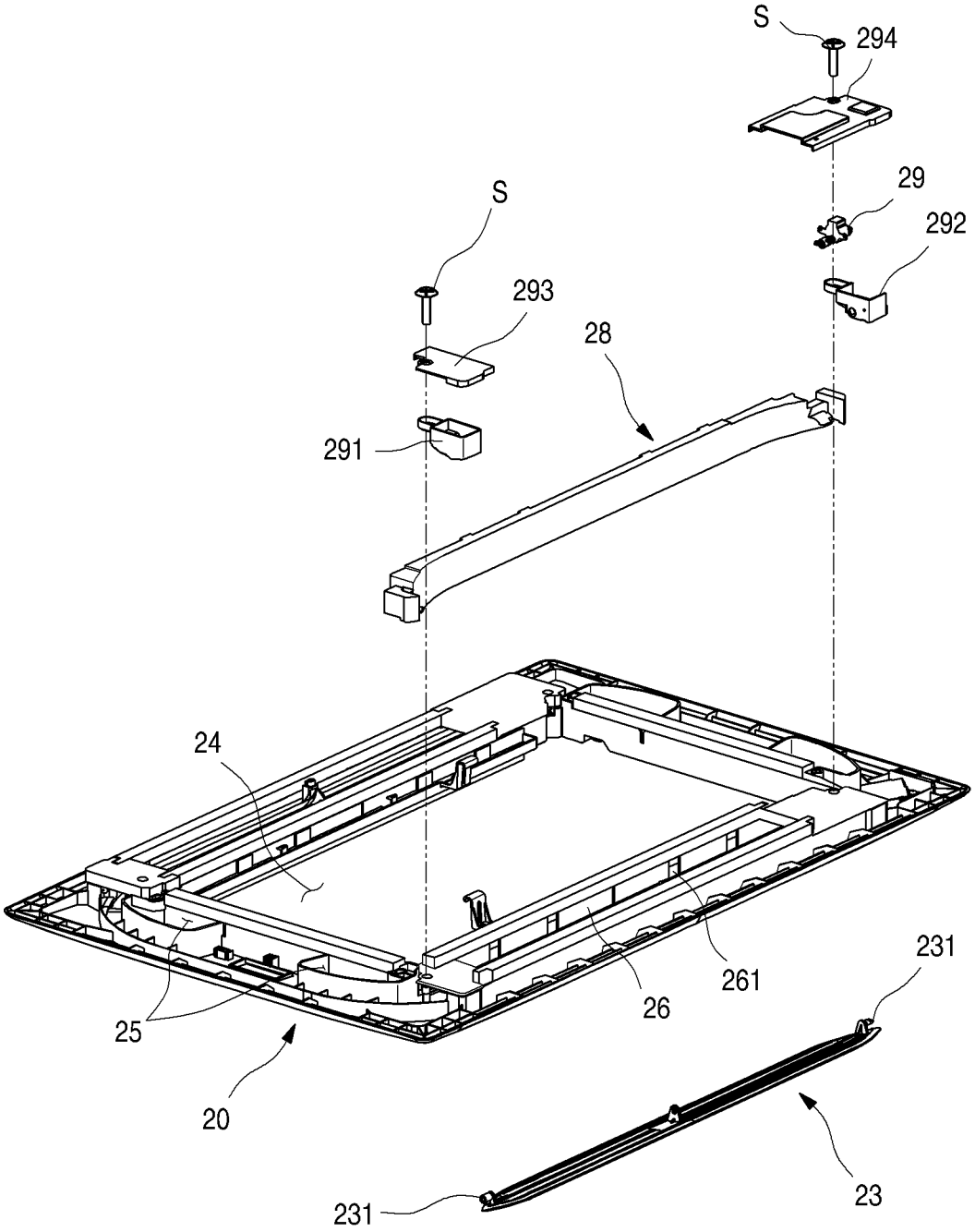
FIG. 9 is a exploded perspective view of the front panel.

FIG. 9 is an exploded perspective view of the front panel. And FIG. 10 is a partial perspective view of the front panel.

Figure 10:
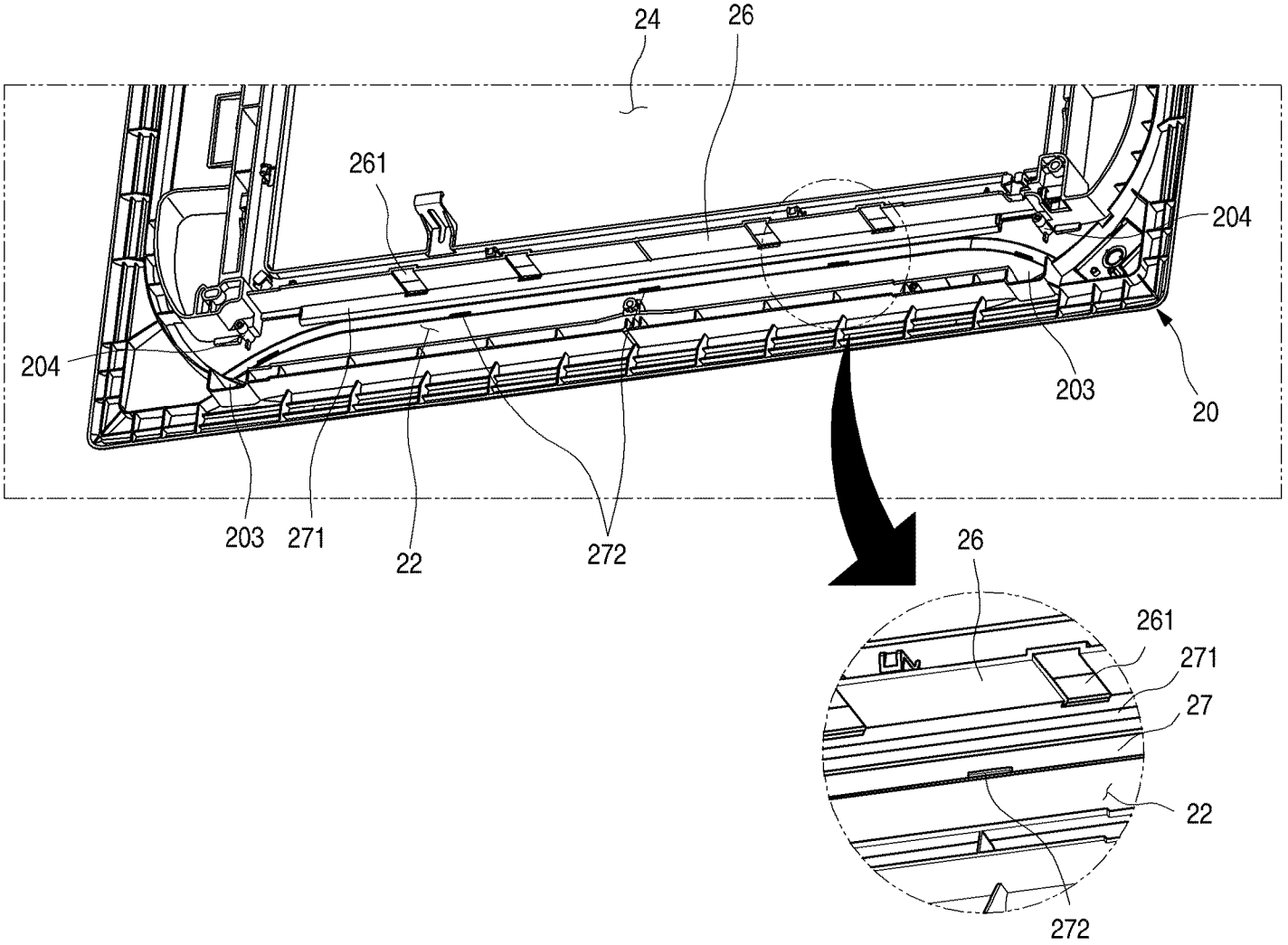
FIG. 10 is a partial perspective view of the front panel.

As shown in FIGS. 9 and 10, the front panel 20 includes a side wall 26 that extends in a vertical direction along one side surface of the panel opening 24. The side wall 26 is extended vertically in the front panel 20 and may be used to support an air guide 28, as described below.

A plurality of coupling grooves 261 may be formed on the side wall 26. The coupling grooves 261 accommodate respectively coupling protrusions (282*a* in FIG. 11) formed on the air guide 28, and they may be spaced apart at predetermined intervals along a longitudinal direction.

An air guide mounting portion 27 on which the air guide 28 is seated may be formed between the side wall 26 and the panel outlet port 22. A protrusion portion 271 protruding along the air guide mounting portion 27 may be formed on the air guide mounting portion 27. For example, the protrusion portion 271 may be a portion of the air guide mounting portion 27 at which a portion of the suction grille 21 is accommodated when the suction grille 21 is mounted. As shown in FIG. 10, the air guide mounting portion 27 may be depressed at the front surface of the front panel 20, and have a protruding shape at the rear surface of the front panel 20.

A slide preventing protrusion 272 may be formed at an end of the air guide mounting portion 27 that is adjacent to the panel outlet port 22. The slide preventing protrusion 272 is restricted to be hanged with one side of the air guide 28 mounted to the air guide mounting portion 27, and prevents the air guide 28 from being pushed or moving out of the mounting position. More than one slide preventing protrusion 272 may be disposed along an outer side of the panel outlet port 22, e.g., the end of the air guide mounting portion 27. The more than one slide preventing protrusion 272 may be spaced apart at predetermined intervals.

A motor case mounting portion 203 may be formed at both sides of the panel outlet port 22. The motor case mounting portion 203 may be used to mount motor cases 291 and 292 in which a vane motor 29 is accommodated. The motor case mounting portion 203 may be formed having a shape corresponding to one end of the motor cases 291 and 292. A case fastening portion 204 may be formed at one side facing the motor case mounting portion 203. The case fastening portion 204 may be formed having a shape of a boss to which a coupling member S is fastened.

Therefore, the motor cases 291 and 292 may be disposed at both sides of the panel outlet port 22, and may be mounted to be fixed or attached by the motor case mounting portion 203 and the case fastening portion 204.

The vane motor 29 may be provided inside of the motor cases 291 and 292. The vane motor 29 may be provided on at least either one of the motor cases 291 and 292 of the right and left sides, and a rotation axis 231 formed on both side ends of the vane 23 and the vane motor 29 may be connected directly or indirectly. It is understood that when the vane motor 29 is not provided on the motor cases 291 and 292 of the left and right sides, the rotation axis of the vane 23 may be rotatably supported through a case hole of the motor cases 291 and 292.

The air guide 28 guides air discharged toward the panel outlet port 22 side and at the same time, being formed of a heat insulating material such as polystyrene, prevents condensation from occurring in the panel outlet port 22 side.

The front panel 20 in which the air guide 28 is mounted may be formed of a material different from that of the air guide 28. For example, the front panel 20 may be formed of a polypropylene material having excellent mold ability. Thus, when the front panel 20 is formed of a polypropylene material, since bending of the front panel 20 becomes severe relatively to the air guide 28, the slide preventing protrusion 272 and the protrusion portion 271 are formed and a stable coupling state with the air guide 28 may be maintained.

Both ends of the air guide 28 may be fixed or attached by the motor cases 291 and 292 of both sides, and both sides of the motor cases 291 and 292 and the air guide 28 may be shielded by top covers 293 and 294, respectively. For example, the top covers 293 and 294 may be fixed to the motor cases 291 and 292 or the front panel 20.

Figure 11:
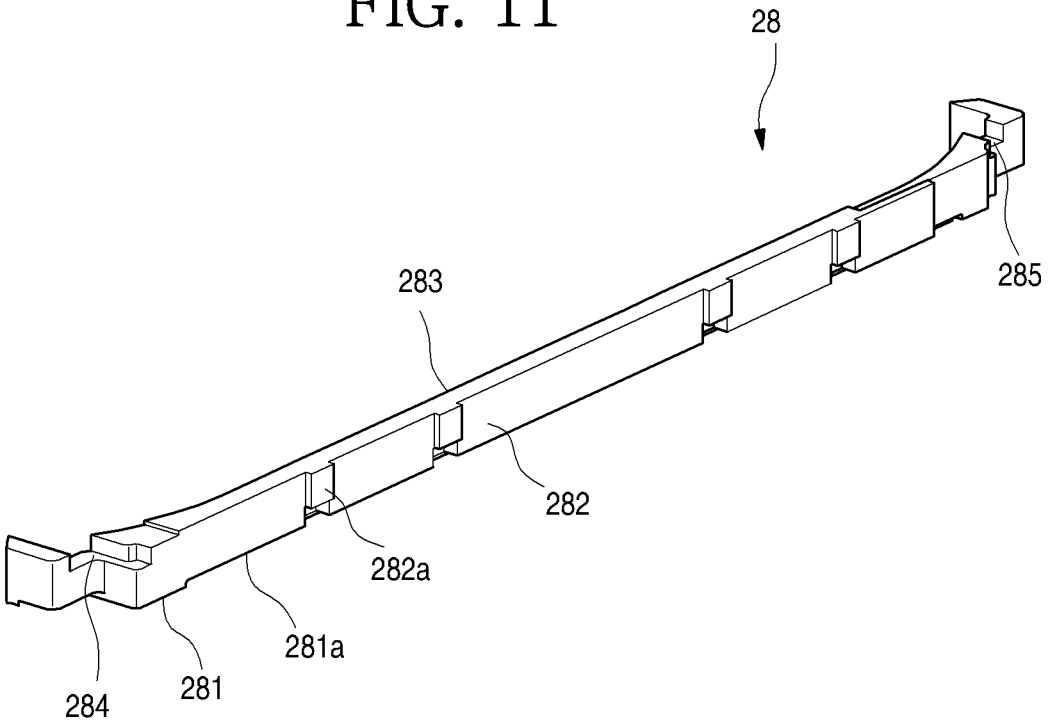
FIG. 11 is a perspective view of the air guide.
Figure 12:
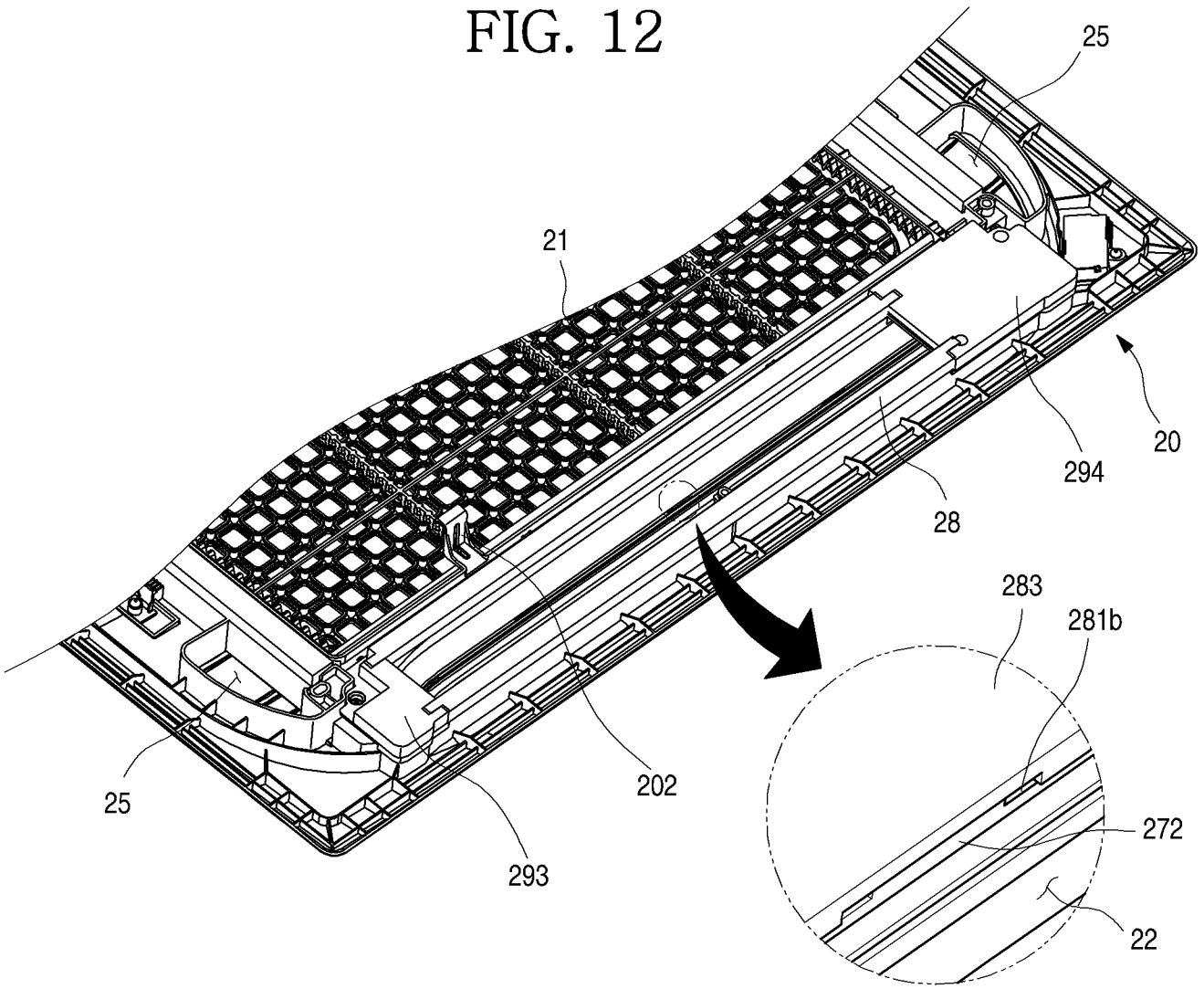
FIG. 12 is a partial perspective view of a state in which the air guide is mounted on the front panel.
Figure 13:
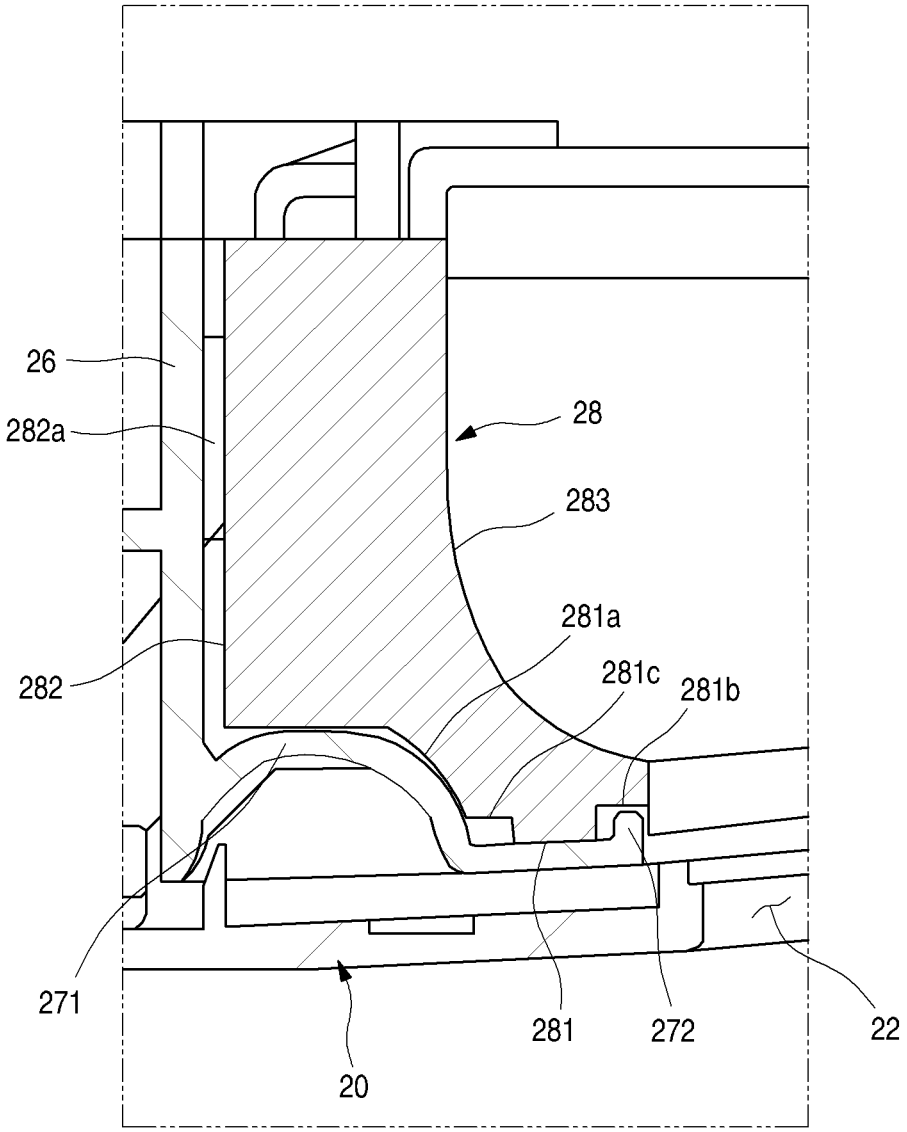
FIG. 13 is a cross-sectional view of a state in which the air guide is mounted on the front panel.

FIG. 11 is a perspective view of the air guide. And FIG. 12 is a partial perspective view of a state in which the air guide is mounted on the front panel. FIG. 13 is a cross-sectional view of a state in which the air guide is mounted on the front panel.

As shown in FIGS. 11, 12, and 13, the air guide 28 is elongated along the air guide mounting portion 27, and may be formed along the longitudinal direction of the panel outlet port 22. The air guide 28 may be mounted or attached to an inner side surface of the front panel 20. For example, the air guide 28 may be attached to the side wall 26 and the air guide mounting portion 27 by a glue, etc. and additionally, the both sides portions is pressed by the motor cases 291 and 292 and may be mounted to be fixed to the front panel 20.

The air guide 28 may be formed so as to extend along an end of the panel outlet port 22. The air guide 28 may be formed to include a lower surface 281 coupled with the air guide mounting portion 27, a rear surface 282 supported by the side wall 26, and a guide surface 283 guiding the discharged air to the panel outlet port 22 side.

The lower surface 281 may include a seating portion 281*a* corresponding to the protrusion portion 271 so as to be seated in the air guide mounting portion 27. The seating portion 281*a* may be formed having a depressed shape in order to accommodate the protrusion portion 271, and the lower surface 281 (except the seating portion 281*a*) may be formed to be in contact with the air guide mounting portion 27.

A stepped portion 281*c* formed to be stepped may be further formed at a lower end of the seating portion 281*a*, and the stepped portion 281*c* may form a predetermined space with the air guide mounting portion 27 when the air guide 28 is mounted. Such configuration is for preventing a noise generated upon expansions and contractions of the air guide 28 and the front panel 20 having different coefficients of the expansion according to the temperature difference caused by the discharged air during the operation of the inside unit 1, and a free space may be provided when the air guide 28 or the front panel 20 is expanded and contracted.

A protrusion accommodating groove 281*b* may be formed at a front end of the lower surface 281. The protrusion accommodating groove 281*b* may be formed at a lower surface of the air guide 28 corresponding to the slide preventing protrusion 272. The protrusion accommodating groove 281*b* may be formed having a shape that is depressed to an end of the air guide 28. Therefore, when the air guide 28 is mounted, such as shown in FIG. 12 and FIG. 13, the slide preventing protrusion 272 may be received in the protrusion accommodating groove 281*b*, and therefore, the air guide 28 may maintain a mounting state without sliding when the air is flowing.

The coupling protrusion 282*a* may be formed at the rear surface 282 of the air guide 28. The coupling protrusion 282*a* may be formed to be accommodated in the coupling groove 261 of the side wall 26, and may protrude more than the depth of the coupling groove 261. Therefore, during the mounting of the air guide 28, such as shown in the FIG. 13, the rear surface of the air guide 28 is spaced apart from the side wall 26 and may form a space. The space may prevent or significantly reduce noise generated from bumping during the expansion and contraction of the air guide 28 or the front panel 20 by the temperature difference.

The guide surface 283 is a surface connecting the lower surface of the air guide 28 in the upper surface of the air guide 28. The guide surface 283 may be formed having a predetermined curvature and be rounded. Therefore, air discharged from the inner side of the cabinet 10 may flow along the guide surface 283 and may flow more efficiently into the panel outlet port 22. In addition, the flowed air may flow along the guide surface 283, and the heat transfer to an apposed area of the panel outlet port 22 may be blocked.

The lower end of the guide surface 283 may be formed along the inner side end of the panel outlet port 22. The right and left side ends of the guide surface 283 may be formed to correspond to the curvature of the both sides of the panel outlet port 22 and guide air discharged to the both sides ends of the panel outlet port 22 also to be discharged more efficiently.

Case seating portions 284 and 285 depressed downward may be formed at the right and left sides of the air guide 28. The motor cases 291 and 292 may be seated on the case seating portions 284 and 285, and the case seating portions 284 and 285 may be formed to be depressed downward.

That is, the motor cases 291 and 292 may be seated on the case seating portions 284 and 285 while the air guide 28 is mounted on the air guide mounting portion 27. In such configuration, a portion of the motor cases 291 and 292 may be accommodated in the case mounting portion 203. By fastening a coupling member S penetrating the motor cases 291 and 292 to the case fastening portion 204, the motor cases 291 and 292 may be mounted or fixed. By the fixed mounting of the motor cases 291 and 292, the both ends of the air guide 28, that is the case seating portions 284 and 285, may be pressed to be in close contact with the front panel 20. Therefore, the air guide 28 may be firmly fixed to the front panel 20 by the motor cases 291 and 292 without glue.

Figure 14:
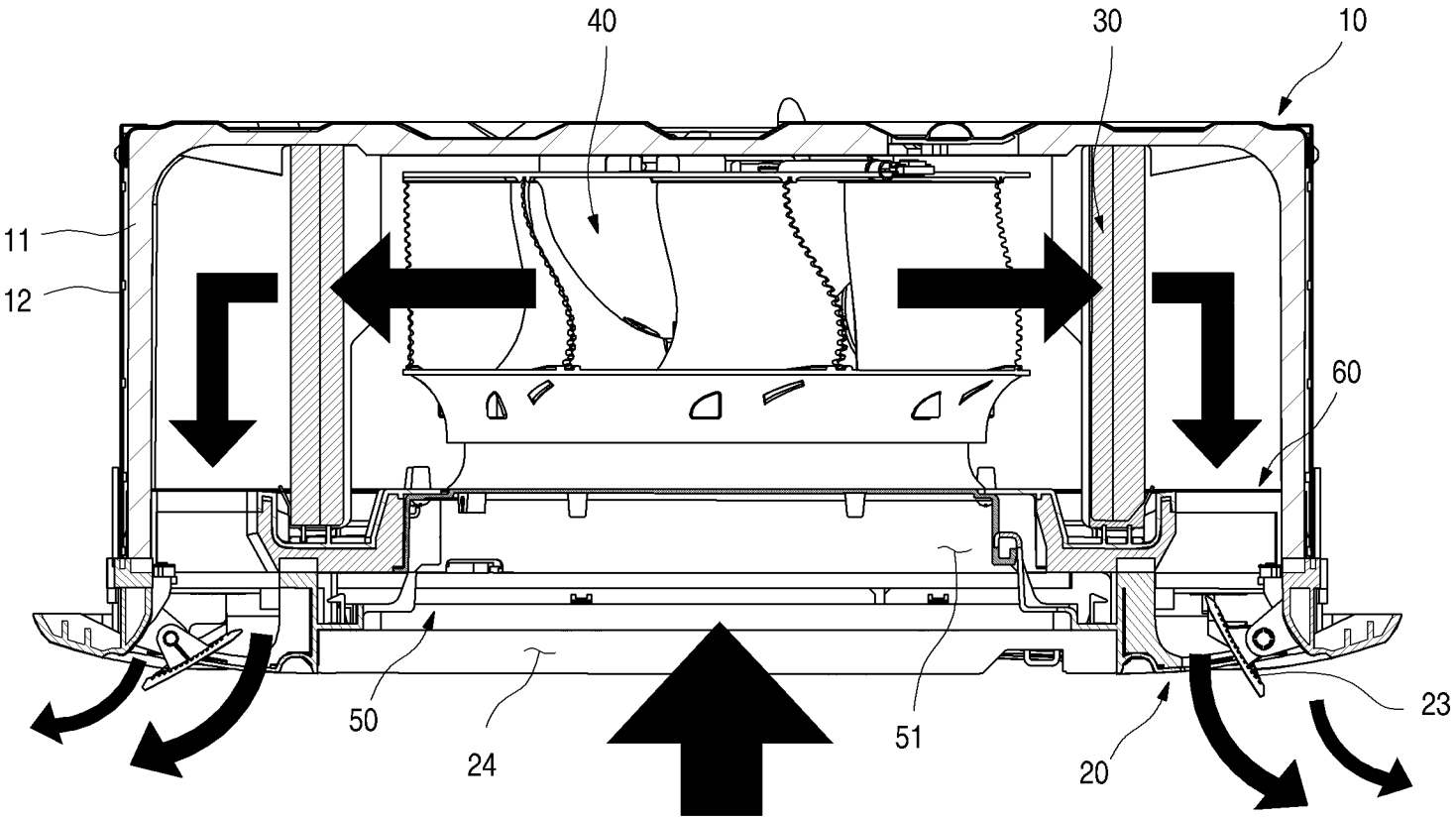
FIG. 14 is a cross-sectional view illustrating the air flow of the inside unit.

Hereinafter, an operation of the inside unit 1 according to an embodiment of the present disclosure having the above-described structure will be described. FIG. 14 is a cross-sectional view illustrating the air flow of the inside unit.

As shown in FIG. 14, when the operation of the inside unit 1 begins, a motor for driving the fan 40 is rotated, and air in the inside space is suctioned into the inner side of the inside unit 1 through the inlet port 213 of the suction grille 21 by the rotation of the fan 40. The suctioned air is suctioned into the center of the fan 40 through the orifice member 50, and is discharged in a circumferential direction of the fan 40.

The air discharged by the fan 40 is exchanging heat with a refrigerant while passing through the heat exchanger 30, and guided to the panel outlet port 22 along a passage inside the cabinet 10. At this time, the air directed to the panel outlet port 22 is guided by the air guide 28 and may be efficiently discharged to the panel outlet port 22.

For example, air discharged by the guide surface 283 of the air guide 28 may be discharged to the outside with a directionality, and a direction discharged by the vane 23 is determined so as to be discharged to the inside space. During the process of passing through the air guide 28 insulated by the air guide 28, the cold air does not directly contact an adjacent portion of the panel outlet port 22, thereby preventing condensation.

Figure 15:
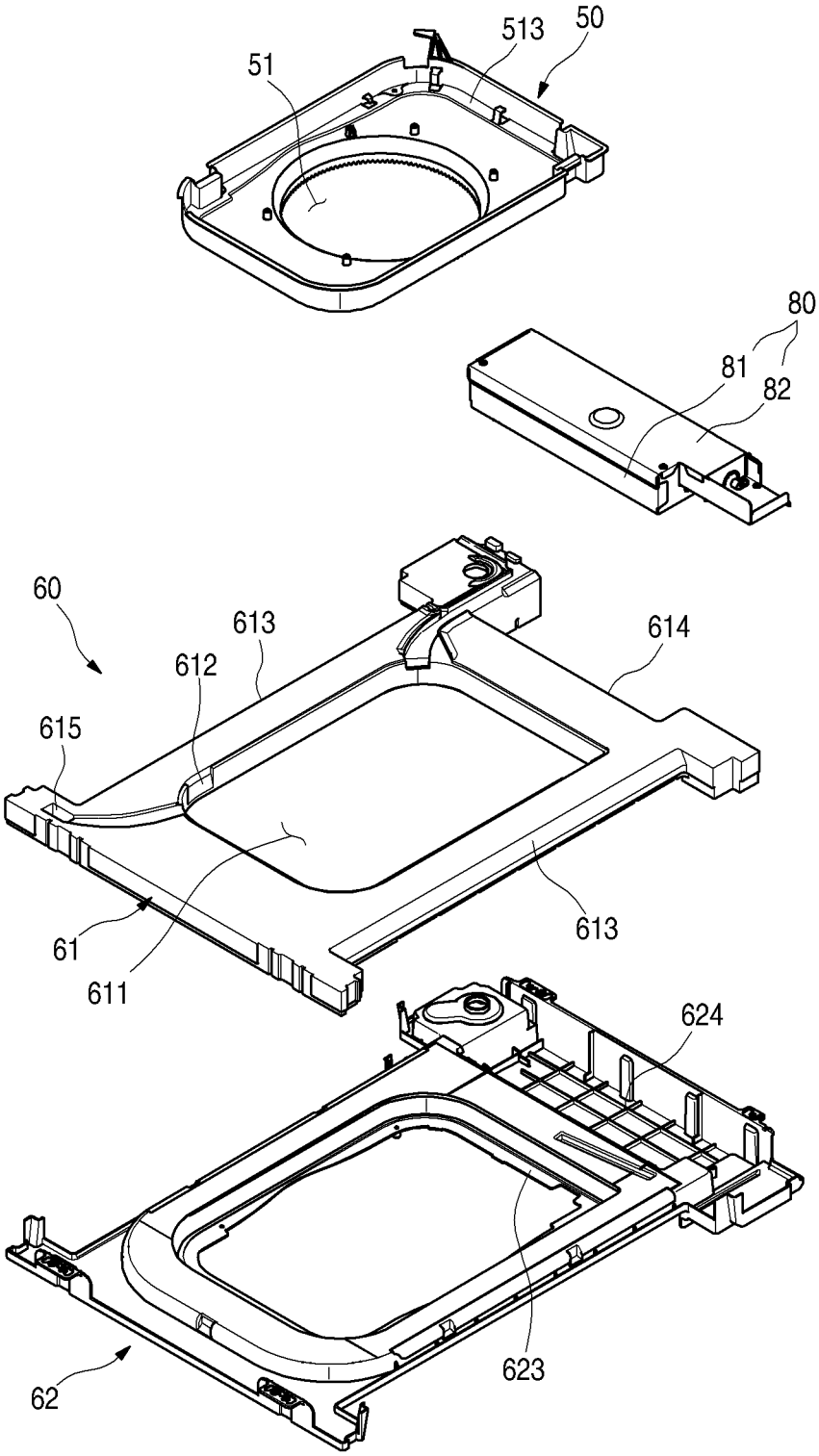
FIG. 15 is a exploded perspective view of a drain pan assembly according to an embodiment of the present disclosure.

FIG. 15 is an exploded perspective view of a drain pan assembly according to an embodiment of the present disclosure. As shown in FIG. 15, the drain pan assembly 60 may be configured with the body 61, the pan plate 62 forming a surface facing the inner side of the inner case 12, and the orifice member 50 mounted at the center of the body 61.

A body opening 611 in which the orifice member 50 is mounted may be formed at the center of the body 61. The front panel inserting portion 612 may be formed at the facing position of the inner side surface of the body opening 611.

As shown, the recessed portion 613 depressed to the inner side surface of the body opening 611 is formed at both side surfaces of the body 61. The box accommodating portion 614 providing a space in which the control box 80 may be disposed may be formed on the other side surface of the body 61.

An orifice seating portion 623 protruding to the inner side of the body opening 611 may be formed at the center of the pan plate 62. As shown, the orifice seating portion 623 may be formed in a shape corresponding to an orifice matching portion 513 formed on a bottom surface of the orifice member 50, and may be configured to be supported while the orifice member 50 is seated.

The control box seating portion 624 disposed on the box accommodating portion 614 side when it is coupled with the body 61 may be formed at one side of the pan plate 62. The control box 80 may be located on the box accommodating portion 614 while being seated on the control box seating portion 624. As such, the control box 80 may be exposed to the panel opening 24 of the front panel 20 when the suction grille 21 is opened.

Figure 16:
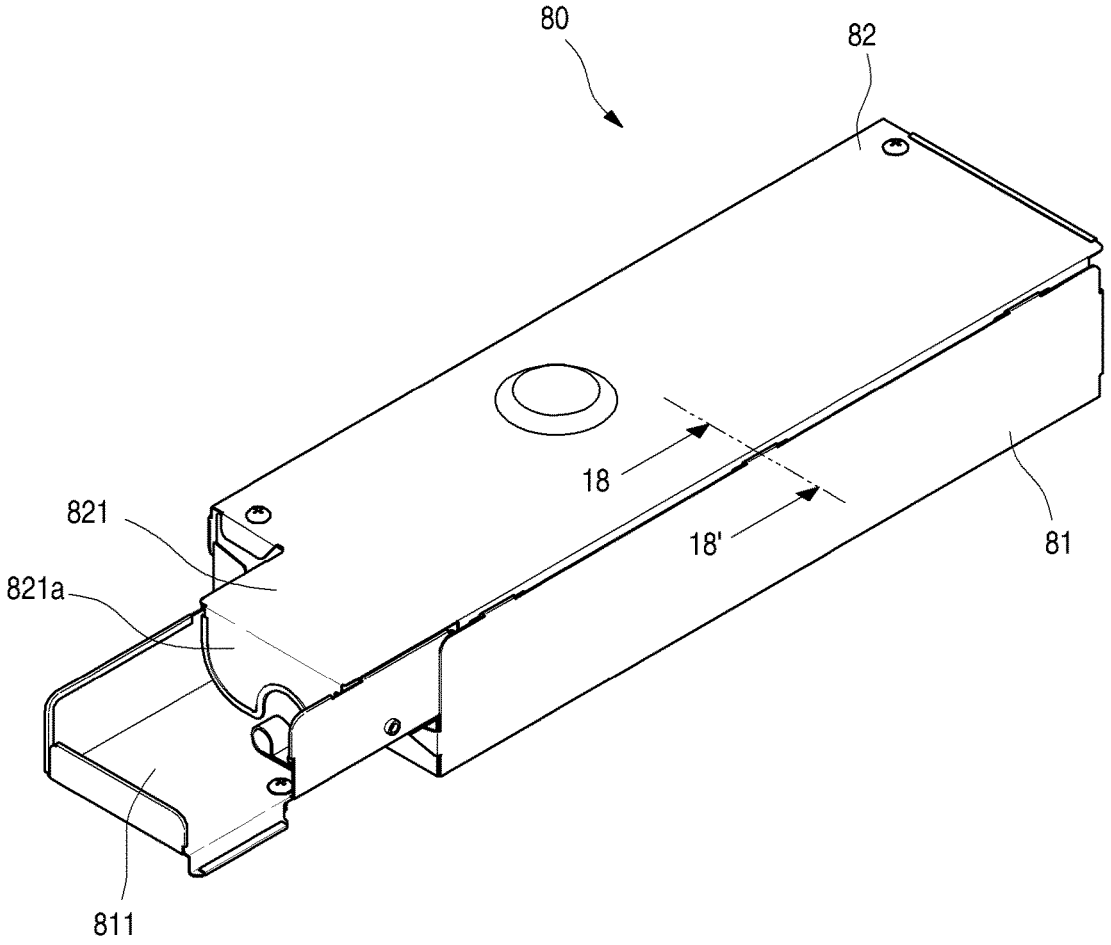
FIG. 16 is a perspective view of the control box.
Figure 17:
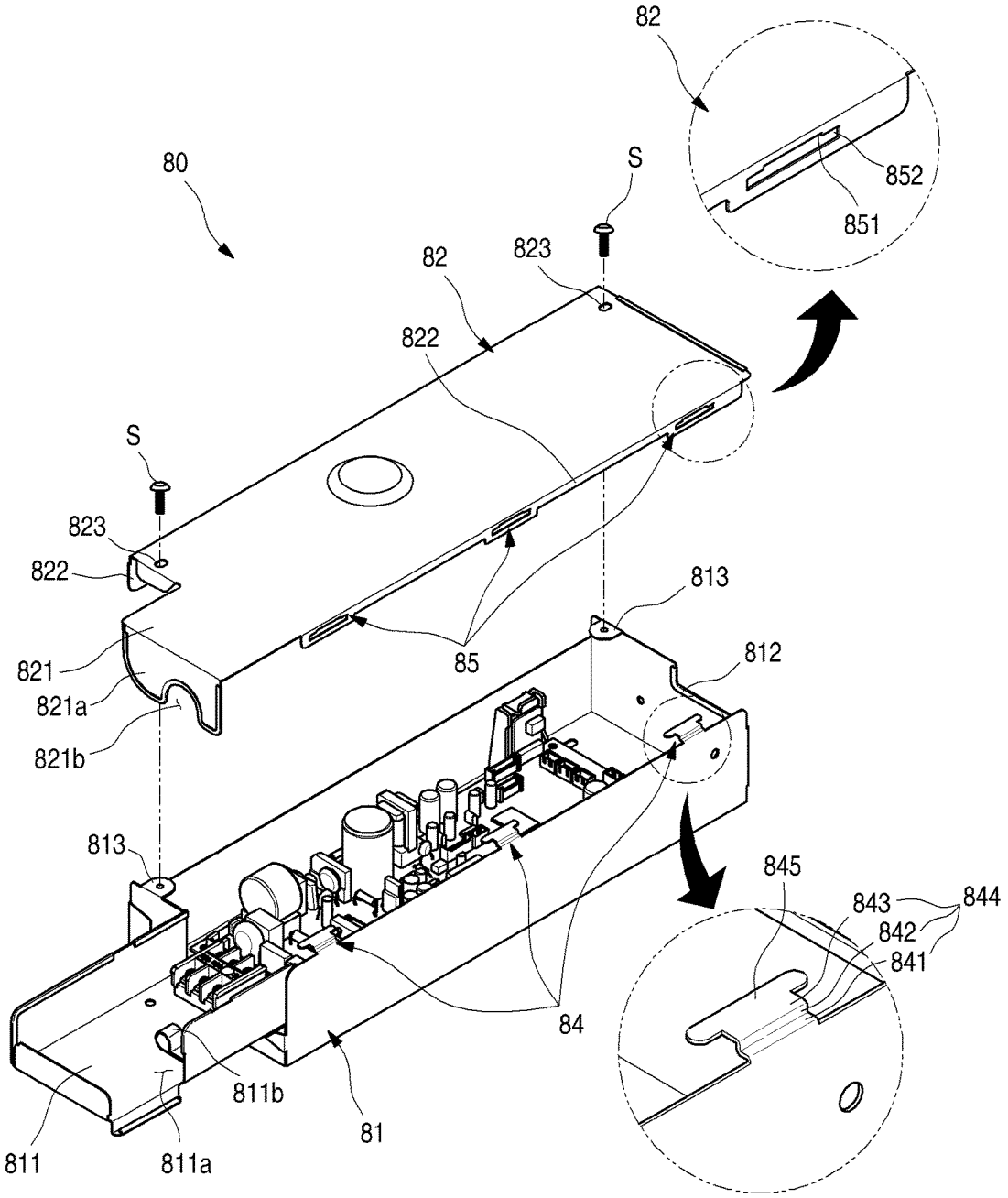
FIG. 17 is a exploded perspective view of the control box.
Figure 18:
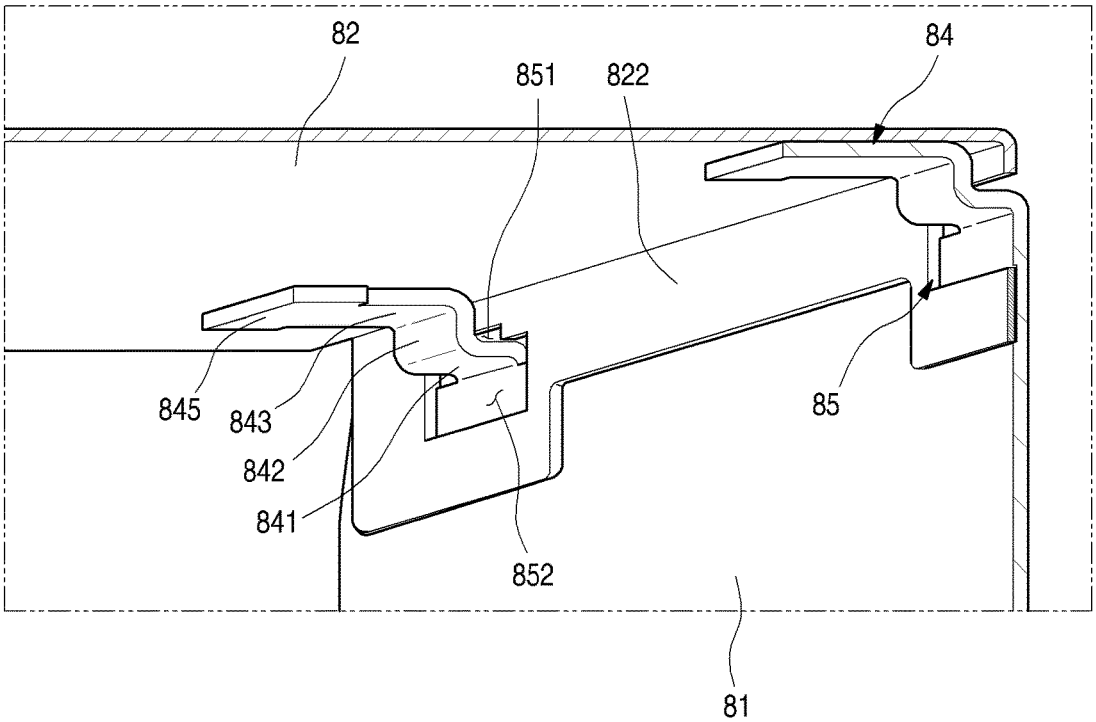
FIG. 18 is a 18-18' cross-sectional view of the FIG. 16.

Hereinafter, the control box will be described in more detail an embodiment of the disclosure. FIG. 16 is a perspective view of the control box an embodiment of the disclosure. FIG. 17 is an exploded perspective view of the control box. FIG. 18 is a 18-18' cross-sectional view of the embodiment shown in FIG. 16.

As shown in FIGS. 16-18, the control box 80 may be configured with a box case 81 and a box cover 82. The box case 81 provides a space in which other electrical components, including the PCP 83, may be mounted therein. As shown in FIG. 16, a metal material in a plate shape may be bent and the upper surface may be formed in an opened box shape.

The box case 81 may be formed to have a shape corresponding to a shape of the control box seating portion 624 and the box accommodating portion 614. In other words, the box case 81 may form one side surface of the drain pan assembly 60 while being mounted on the control box seating portion 624.

A sub case portion 811 extended to the side may be formed at one side of the box case 81. The sub case portion 811 provides an additional space in which the configurations added depending on the model of the inside unit 1 may be connected to the PCB 83.

At least a portion of a cut-away portion 811*a* may be formed at the periphery of the sub case portion 811, such that direct access to the out plate 11 side through the cut-away portion 811*a* is possible. A holder 811*b* for mounting separate wires may be mounted at the bottom surface of the sub case portion 811.

Meanwhile, a box entrance 812 cut away to form a passage in which a wire connected with the configuration inside the inside unit 1 is entered may be formed at a portion of one side surface of the box case 81. Therefore, the wire may be guided in an arranged state through the box entrance 812, and may be connected with the PCB 83 inside the box case 81.

At least one fastening portion 813 may be formed at the upper end of one side of both sides of the box case 81. The fastening portion 813 may be formed to be bent inward so that the top of the box case 81 is vertical, and may form a surface in which the box cover 82 is seated. And, while the box cover 82 is seated, the coupling member S is fastened to penetrate the box cover 82 and the fastening portion 813, so that the box case 81 and the box cover 82 may coupled.

A box coupling protrusion 84 may be formed at a top end of the other side of the box case 81. As shown in FIG. 17, a plurality of box coupling protrusions 84 may be formed at the top end of the box case 81 at a position facing the fastening portion 813, and may be spaced apart at regular intervals.

The box coupling protrusion 84 may extend from an upper end of the box case 81, and may be bent vertically toward the inner side of the box case 81. The box coupling protrusion 84 may be inserted into a cover coupling port 85 of the box cover 82 (described below) so that the box cover 82 is coupled to the box case 81, and may be separated from the box case 81 or may open the box case 81 in a rotated and suspended form according to a user's manipulation.

The box coupling protrusion 84 may be configured with a bent portion 844 extended from the upper end of the box case 81 and a restriction portion 845 formed on an end of the bent portion 844. The bent portion 844 may extend toward the inner side of the box case 81. The bent portion 844 may be configured with a first extending portion 841, a second extending portion 843, and a connection portion 842 connecting the first extending portion 841 and the second extending portion 843. The first extending portion 841 may be located below the second extending portion 843, and may be connected with the upper end of the box case 81.

Meanwhile, the restriction portion 845 may be formed at the end of the bent portion 844. The restriction portion 845 prevents the box cover 82 from being arbitrarily extracted or removed. As shown, the restriction portion 845 may be shaped such that it has a greater width than a width of the bent portion 844.

The box cover 82 shields the opened upper surface of the box case 81, and is formed to shield the remaining portion except a portion of the sub case portion 811. A sub cover portion 821 is formed at a side of the box cover 82, and the sub cover portion 821 may shield a portion of the sub case portion 811. As shown, one side of the sub cover portion 821 may be bent downward, and may form a shielding portion 821*a*, and a guide portion 821*b* for the entry of the wire may be further formed on a center of the shielding portion 821*a*.

A portion of an edge 822 of the box cover 82 may bent downward, and may be configured to be inserted to the inner side of the box case 81 so as to be in contact with a peripheral surface of the box case 81.

A screw hole 823 may be formed at both sides of the box cover 82 seated on the fastening portion 813, and a coupling member S such as a screw, may be fastened to the screw hole 823 so that the box cover 82 may be fixed or attached to the box case 81.

The cover coupling port 85 may be formed at a peripheral side of the box cover 82, more specifically, an end which is in contact with the box coupling protrusion 84 when the box cover 82 is mounted. There may be more than one cover coupling port 85 formed thereon.

The cover coupling port 85 may be configured with an upper opening portion 851 and a lower opening portion 852 forming one hole which has different vertical widths. The upper opening portion 851 and the lower opening portion 852 are connected to each other and form a single opening.

As shown in FIG. 17, the upper opening portion 851 may be located above the lower opening portion 852. The upper opening portion 851 may have a narrower width than the width of the lower opening portion 852. The width of the upper opening portion 851 may be greater than a width of the bent portion 844 and smaller than a width of the restriction portion 845. Accordingly, when the bent portion 844 is located at the upper opening portion 851, the movement of the box cover 82 is available, but the restriction portion 845 may be restricted without passing through the upper opening portion 851.

The height of the vertical direction of the upper opening portion 851 may be lower than the vertical height of the bent portion 844. Therefore, when the box cover 82 is pulled forward in the state in which the box cover 82 is closed (such as shown in FIG. 6), the box cover 82 may not be easily separated from the box case 81 by the interference of the bent portion 844.

The lower opening portion 852 may be located below the upper opening portion 851. The width of the lower opening portion 852 may be larger than the width of the upper opening portion 851. That is, the width of the lower opening portion 852 may be larger than the width of the restriction portion 845, and therefore, when the box cover 82 is lifted so that the restriction portion 845 is located in the lower opening portion 852, the end of the box coupling protrusion 84 passes through the cover coupling port 85 and may separate the box cover 82 from the box case 81.

Figure 19:
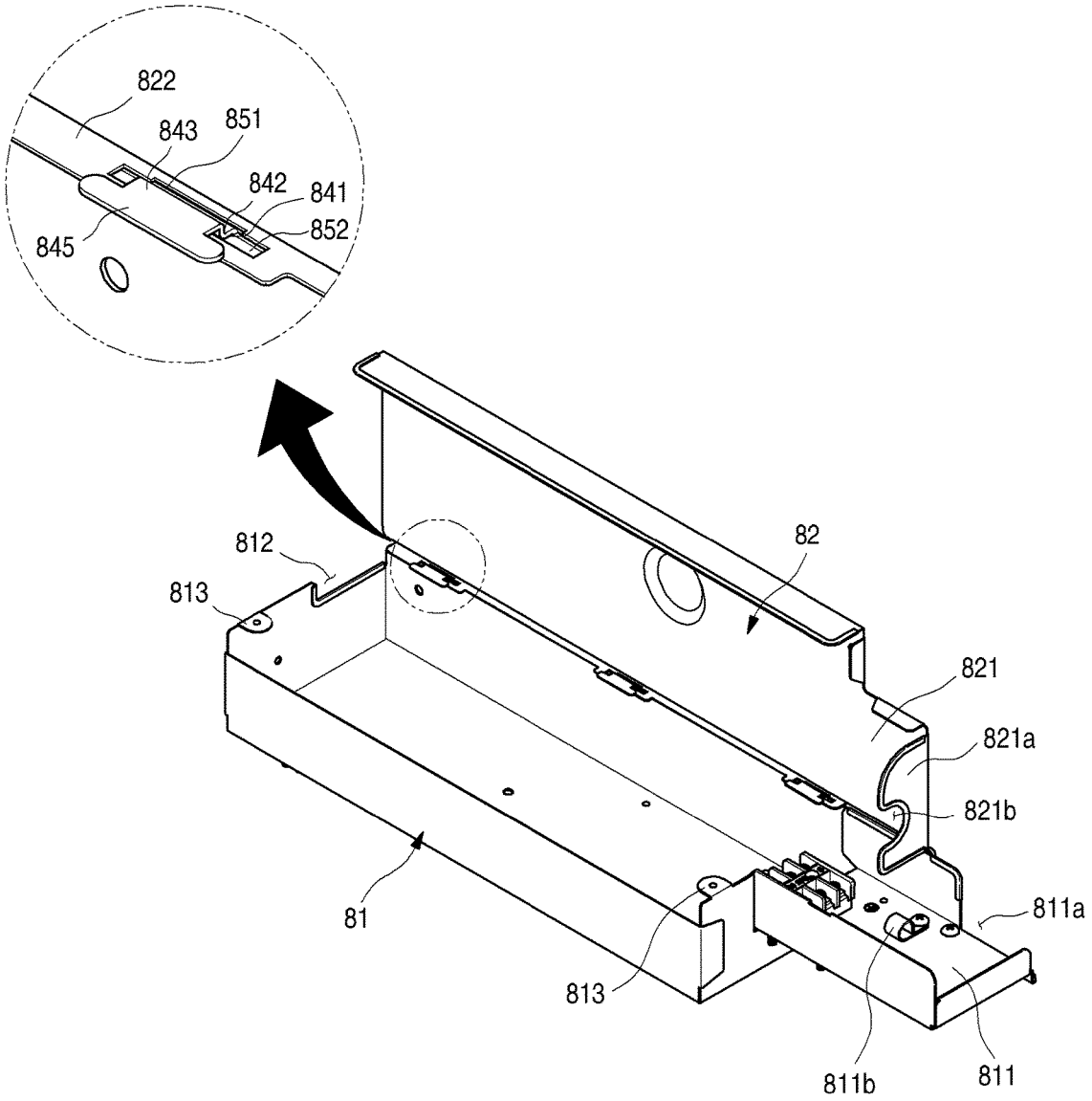
FIG. 19 is a perspective view of the opened control box.

FIG. 19 is a perspective view of the opened control box according to an embodiment of the disclosure. As shown in FIG. 19, the box cover 82 constituting the control box 80 may be rotated when the box coupling protrusion 84 is inserted into the cover coupling port 85, and may be suspended in the box case 81.

The box cover 82 shields the opened surface of the box case 81 in the state shown in FIG. 6. In this state, the user releases the coupling member S and removes the engagement of the box cover 82 and the fastening portion 813. The box cover 82 is then pulled frontward so that the box cover 82 is spaced apart from a side surface of the box case 81, and then rotated.

The box cover 82 may open the box case 81 in the rotated state, such as shown in FIG. 19, and due to the nature of the position in which the box cover 82 is mounted, the box cover 82 may be vertically suspended with respect to a bottom surface of the box cover 82 by its own weight.

The outer side of the cover coupling port 85 becomes a seated state on the second extending portion 843, and the box cover 82 maintains a suspended state. At this time, the bent portion 844 is located on the lower opening portion 852.

Thus, when the box cover 82 is rotated and opened (such as shown in FIG. 19), the box cover 82 is not easily separated by the interference of the bent portion 844. In order to separate the box cover 82, the lower opening portion 852 separates the box cover 82 while rotating and operating the box cover 82 so as to pass through the bent portion 844 and the restriction portion 845.

Figure 20:
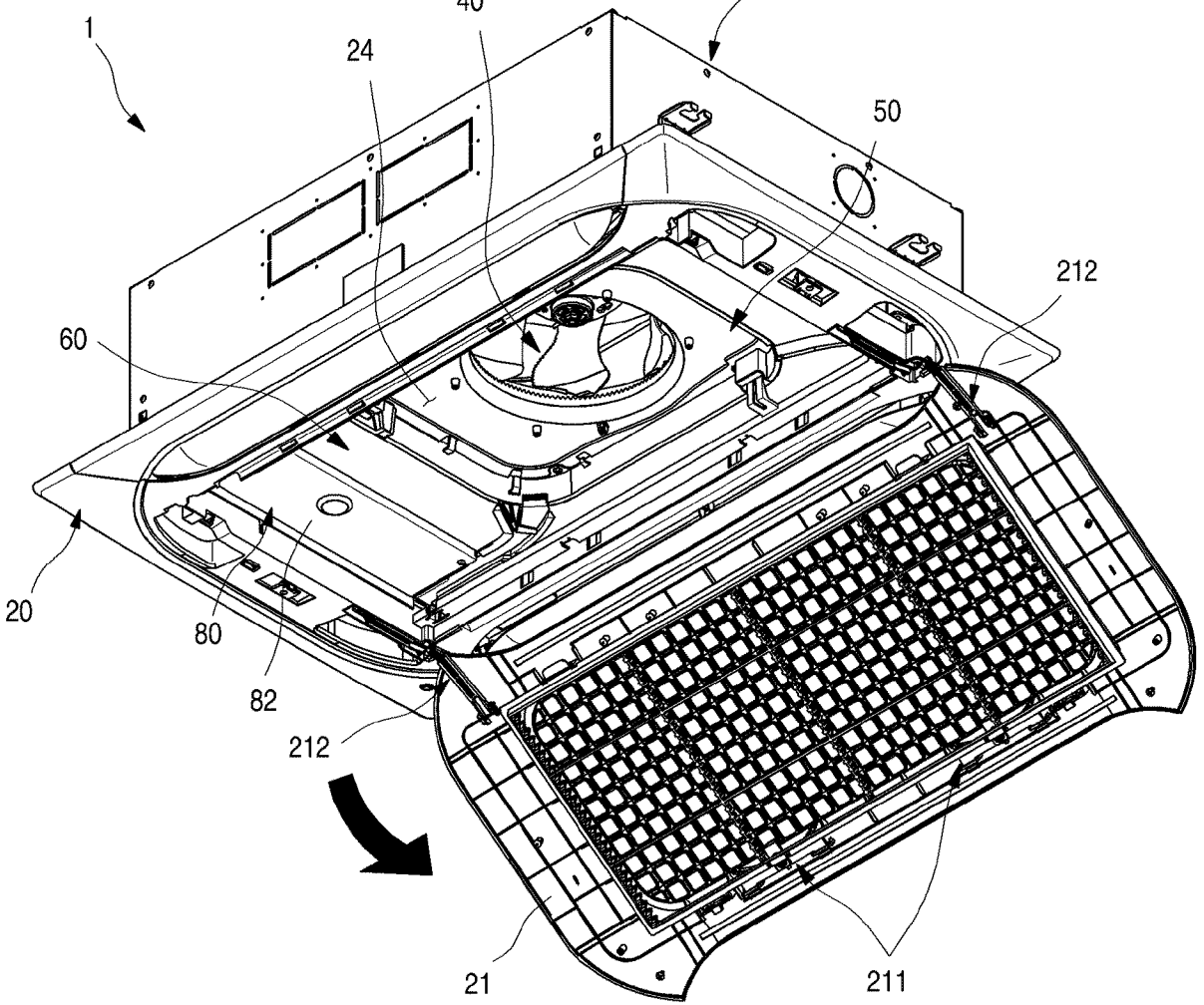
FIG. 20 is a perspective view of the opened suction grille according to an embodiment of the present disclosure.
Figure 21:
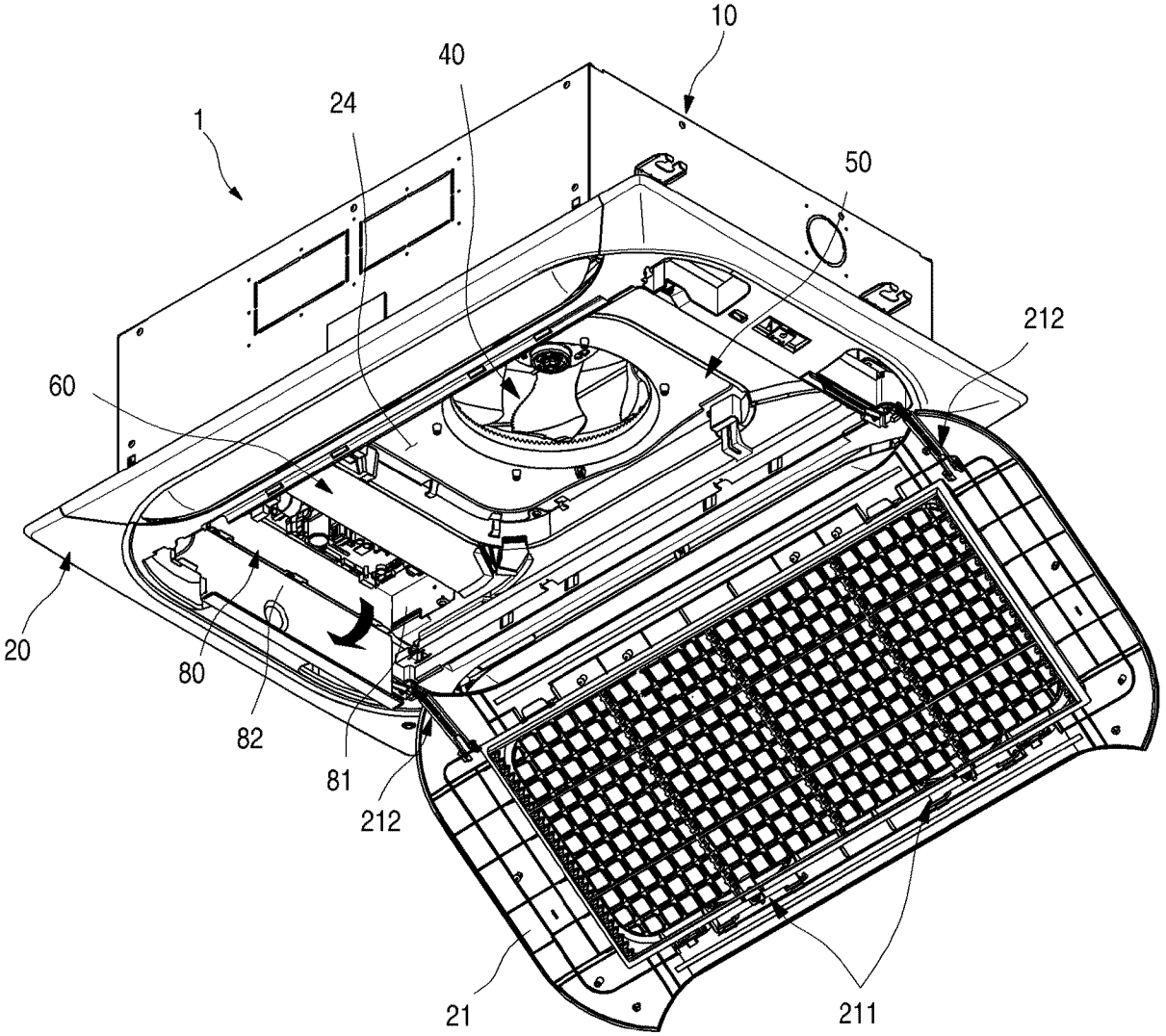
FIG. 21 is a perspective view of the opened control box.

Hereinafter, a service process of the control box 80 of the inside unit 1 according to an embodiment of the present disclosure having the structure as described above will be described. FIG. 20 is a perspective view of the opened suction grille according to an embodiment of the present disclosure. FIG. 21 is a perspective view of the opened control box.

As shown in FIGS. 20 and 21, when a service such as an inspection or replacement of the PCB 83 is required while the inside unit 1 is mounted on the ceiling, first the suction grille 21 is opened as shown in FIG. 20.

For opening the suction grille 21, the restraint of the suction grille 21 and the front panel 20 is released by operating the restriction device 211. In this situation, the opposite side of the restriction device 211 is connected to the hinge device 212, and may be rotated by the hinge device 212 while being connected to the front panel 20.

By this operation, the suction grille 21 may fully open the panel opening 24 of the front panel 20, so that the inside of the cabinet 10 may be exposed through the panel opening 24. The drain pan assembly 60 of the cabinet 10 and the control box 80 may be exposed through the panel opening 24, and especially, the box cover 82 of the control box 80 may be exposed.

While the box cover 82 is exposed, the user may separate the coupling member S fastened to the box cover 82. Through the separation of the coupling member S, the coupling of the box cover 82 and the fastening portion 813 is released, and the box cover 82 may be in a rotatable state.

While the box cover 82 is mounted, the box coupling protrusion 84 is inserted into the cover coupling port 85, and in this situation, the user moves the box cover 82 by a predetermined distance along the bent portion 844 and rotates the box cover 82 while the circumference of the box cover 82 and the circumference of the box case 81 are spaced apart.

The interior of the box case 81 may be fully exposed by the rotation of the box cover 82. The box coupling protrusion 84 has been rotated while being inserted into the inner side of the cover coupling port 85, and since it maintains the inserted state into the cover coupling port 85, the box coupling protrusion 84 maintains a suspended state to the box case 81 without being separated from the box case 81.

At this time, because the box coupling protrusion 84 and the cover coupling port 85 are located at the end side of the panel opening 24, when the box cover 82 is opened, the box cover 82 does not block the view of the operator and the interior of the box case 81 is visible.

In addition, a width of the box cover 82 is smaller than a width of the panel opening 24, and even during the rotating operation of the box cover 82, the box cover 82 is no longer interfered with the front panel 20.

Meanwhile, when the service such as the inspection or replacement and repair of the PCB 83 is completed by the opening of the control box 80, the operator may re-rotate and close the box cover 82, fasten the coupling member S and fix the box cover 82 to the box case 81.

Finally, the user may rotate the suction grille 21 to the original position and shield the panel opening 24, and constrain the restriction device 211 to the front panel 20 so that the suction grille 21 is fixed to the front panel 20.

According to the present disclosure having the configuration as described above may be expected have the following effects.

The suction grille is mounted to be openable and closable on the front panel, and the panel opening on the front panel and the access holes may be simultaneously opened by the opening and closing of the suction grille. In addition, the access holes may be respectively located at the vertical line of the mounting bracket, and thus the operation of an installation means coupled to the mounting bracket may be possible through the access holes. Therefore, the operation of the installation means may be possible by simply opening the suction grille without removing the entire front panel or opening the cover of the each access hole, so there is an advantage that an installation of the inside unit or a service after installation can be more easily performed.

In addition, as a suction grille configured for opening the panel opening of the front panel opens and closes the access hole at the same time, and controls the installation of the inside unit with a very simple structure, there is an advantage that the productivity and assembly workability are improved.

In addition, as the front panel may be fixed in such a manner that a panel coupling portion formed on the front panel is inserted into a hook coupling port of the drain pan assembly, there is an advantage that an operation during assembly and disassembly of the front panel is more easily and securely performed.

In addition, an air guide having a guide surface may be provided on the front panel in which an outlet port is formed so that discharged air flows more efficiently, and cooled air is prevented from being in direct contact with a region adjacent to the outlet port which improves insulation and blocks condensation from occurring.

In addition, as the air guide may be coupled to a slide preventing protrusion on the front panel, even when constant air flows, the air guide does not slide and may maintain the mounting position. Therefore, a noise due to vibration and trembling in accordance with the change of the mounting position of the air guide may be prevented or significantly reduced.

In addition, a space may be formed between with the air guide, a side wall contacted with the air guide and an outer side of an air guide mounting portion to have a free space when a portion of the air guide and the front panel is deformed by the difference in coefficient of expansion due to a difference in material by the temperature difference caused by the flowed air, and the space may prevent or significantly reduce a noise due to crash generated upon expansion or contraction deformation.

In addition, a motor case may be mounted at both sides of the air guide and the motor case may be fixedly mounted by pressing the both sides of the air guide, and thus the air guide may maintain a more stable and robust fixing state on the front panel.

And, for service of the control box, by opening the suction grille without an additional operation of separating the front panel, the access to the control box becomes available, and therefore, improves the serviceability of the control box.

And, for accessing to the control box, the suction grille may be fully opened with a minimum operation of the restriction device of the suction grille, and a mounting state of the suction grille may be maintained by a hinge device, thereby further improving the ease of the operation.

In addition, the control box may be configured with a box case and a box cover, and as the box cover is rotatably mounted but maintains a suspended state to the control box, the service work is more easily performed.

In addition, as the box cover opens the box case by rotating toward a close side to the end of the panel opening, the workability may be further enhanced by enabling access to the interior of the box case without interference by the box cover.

Although embodiments have been described with reference to a number of illustrative embodiments thereof, it will be understood by those skilled in the art that various changes in form and details may be made therein without departing from the spirit and scope of the invention as defined by the appended claims. Therefore, the preferred embodiments should be considered in descriptive sense only and not for purposes of limitation, and also the technical scope of the invention is not limited to the embodiments. Furthermore, the present disclosure is defined not by the detailed description but by the appended claims, and all differences within the scope will be construed as being comprised in the present disclosure.

What is claimed is:

1. An inside unit of an air conditioner, comprising:

a cabinet housing a fan and a heat exchanger;

a front panel attached at an opening of the cabinet, the front panel forming an inlet port through which inside air is suctioned into a depressed inner side area, and an outlet port through which heat-exchanged air is discharged;

a vane provided at the outlet port to control an opening degree of the outlet port;

an air guide that extends along an outer side end of the outlet port;

a slide preventing protrusion that protrudes from the front panel in which the air guide is mounted; and a protrusion accommodating groove formed at the bottom surface of the air guide to accommodate the slide preventing protrusion, wherein a side wall supporting a surface of the air guide is formed on the front panel, a coupling groove is formed on the side wall, and a coupling protrusion protruding from the air guide is inserted in the coupling groove.

2. The inside unit of the air conditioner of claim 1, wherein more than one slide preventing protrusion is formed to protrude along an end of the outlet port.

3. The inside unit of the air conditioner of claim 1, wherein the air guide includes a guide surface that is curved to guide a flow of the air to the outlet port.

4. The inside unit of the air conditioner of claim 1, wherein the coupling protrusion protrudes further than a depth of the coupling groove and separates the side wall and the air guide.

5. The inside unit of the air conditioner of claim 1, further comprising:

a protrusion portion formed on the front panel, the protrusion portion protruding toward an inward direction along a longitudinal direction of the outlet port; and a seating portion formed on a lower surface of the air guide, the seating portion having a depressed shape that is configured to accommodate the protrusion portion.

6. The inside unit of the air conditioner of claim 5, wherein a lower surface of the seating portion includes a stepped portion that forms a space between the front panel and the air guide.

7. The inside unit of the air conditioner of claim 1, further comprising:

a case seating portion that is formed at opposite ends of the air guide, the case seating portion configured to accommodate a vane motor case.

8. The inside unit of the air conditioner of claim 1, further comprising:

a mounting bracket provided at an outer side surface of the cabinet;

an installation device coupled to the mounting bracket;

a grille accommodating portion forming a panel opening formed to be depressed in the front panel, and through which the inside air is suctioned into the depressed inner side area;

a suction grille to open and close the grille accommodating portion, the suction grille forming the inlet port; and an access hole that is opened at the grille accommodating portion so that the mounting bracket is exposed.

9. The inside unit of the air conditioner of claim 8, wherein the access hole is located on a longitudinally extending line of the mounting bracket.

10. The inside unit of the air conditioner of claim 8, wherein the grille accommodating portion includes an edge portion that extends toward the mounting bracket along the perimeter of the access hole.

11. The inside unit of the air conditioner of claim 1, further comprising:

a drain pan assembly provided at an inner side of the cabinet, the drain pan assembly forming an air flow passage and collecting condensed water generated at the heat exchanger; and an orifice member provided at the drain pan assembly, the orifice member forming a passage for the suctioned air to flow toward the fan.

12. The inside unit of the air conditioner of claim 1, further comprising:

a drain pan assembly provided at an inner side of the cabinet, the drain pan assembly forming an air flow passage and collecting condensed water generated at the heat exchanger;

a panel opening provided at a center of the front panel;

a suction grille configured to open and close the panel opening and forming the inlet port; and a control box provided at the inner side of the cabinet and exposed to the panel opening.

13. The inside unit of the air conditioner of claim 12, further comprising:

a control box accommodating portion to accommodate the control box, the control box accommodating portion being formed in the drain pan assembly proximate a side surface of the cabinet.

14. The inside unit of the air conditioner of claim 12, wherein a length of the control box is shorter than a width of the panel opening such that the control box is exposed through the panel opening.

15. The inside unit of the air conditioner of claim 12, wherein the control box comprises:

a box case to accommodate a printed circuit board, and a box cover rotatably mounted on the box case and configured to be opened through the panel opening.

16. The inside unit of the air conditioner of claim 15, further comprising:

a box coupling protrusion formed at an upper end of the box case, the box coupling protrusion protruding inward, and a cover coupling port formed at the box cover in which the box coupling protrusion is inserted, wherein the box coupling protrusion is formed at an edge bent from a side end of the box cover.

17. The inside unit of the air conditioner of claim 16, wherein the box coupling protrusion includes an extending portion extended from the box case and bent to be stepped upward, and a restriction portion protruding from an end of the extending portion to both sides thereof, and wherein the cover coupling port includes an upper opening portion and a lower opening portion, whereby a width of the upper opening portion is greater than a width of the extending portion and less than a width of the restriction portion, and a width of the lower opening portion is greater than a width of the restriction portion.

18. The inside unit of the air conditioner of claim 12, further comprising:

a hinge connected to the suction grille and the front panel, the hinge being configured to rotate the suction grille.

19. The inside unit of the air conditioner of claim 17, further comprising:

a restriction device provided at the suction grille, the restriction device configured so as to be manipulated to selectively release the suction grille from the front panel, wherein the restriction device is at least partially exposed to the outside of the suction grille.

* * * * *